US010042275B2

(12) United States Patent
Iwase et al.

(10) Patent No.: US 10,042,275 B2
(45) Date of Patent: Aug. 7, 2018

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Masaki Iwase, Kanagawa (JP); Atsushi Sugawara, Kanagawa (JP); Tsuyoshi Murakami, Kanagawa (JP); Kana Yoshida, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/493,718

(22) Filed: Apr. 21, 2017

(65) Prior Publication Data

US 2018/0113392 A1 Apr. 26, 2018

(30) Foreign Application Priority Data

Oct. 20, 2016 (JP) ..... 2016-206250

(51) Int. Cl.

| | |
|---|---|
| ***G03G 9/097*** | (2006.01) |
| ***G03G 9/087*** | (2006.01) |
| ***G03G 9/09*** | (2006.01) |
| ***G03G 9/08*** | (2006.01) |
| ***G03G 15/08*** | (2006.01) |
| ***G03G 21/16*** | (2006.01) |

(52) U.S. Cl.

CPC ..... *G03G 9/08755* (2013.01); *G03G 9/0804* (2013.01); *G03G 9/0808* (2013.01); *G03G 9/0819* (2013.01); *G03G 9/0821* (2013.01); *G03G 9/0827* (2013.01); *G03G 9/0902* (2013.01); *G03G 15/0865* (2013.01); *G03G 21/1676* (2013.01); *G03G 2221/163* (2013.01)

(58) Field of Classification Search

CPC ..... G03G 9/09725; G03C 9/097

See application file for complete search history.

(56) References Cited

U.S. PATENT DOCUMENTS

2005/0147908 A1* 7/2005 Yamane ..... G03G 9/09708 430/108.3
2012/0148948 A1 6/2012 Ikeda et al.
2013/0330522 A1* 12/2013 Suzuki ..... G03G 9/0902 428/195.1

FOREIGN PATENT DOCUMENTS

JP 2012-128008 A 7/2012

* cited by examiner

*Primary Examiner* — Hoa V Le
(74) *Attorney, Agent, or Firm* — Sughrue Mion, PLLC

(57) ABSTRACT

An electrostatic charge image developing toner includes toner particles containing a binder resin and a white pigment, wherein, in a particle size distribution of a maximum Feret diameter of particles of the white pigment present in the toner particle, a ratio of particles of the white pigment having a maximum Feret diameter of 200 nm or more and less than 400 nm is 50% by number or more with respect to the entire particles of the white pigment, and a maximum value of a frequency with respect to particles of the white pigment having a maximum Feret diameter of 650 nm or more and less than 1,000 nm is larger than a minimum value of a frequency with respect to particles of the white pigment having a maximum Feret diameter of 500 nm or more and less than 650 nm.

12 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-206250 filed Oct. 20, 2016.

BACKGROUND

1. Technical Field

The present invention relates to an electrostatic charge image developing toner, an electrostatic charge image developer, and a toner cartridge.

2. Related Art

In an image formation according to an electrophotographic system, toner is used as an image forming material. For example, toner which includes a toner particle containing a binder resin and a coloring agent, and an external additive which is externally added to the toner particle, is widely used.

In addition, in an image formation according to an electrophotographic system, a technique of using toner which includes a toner particle containing a white pigment is known in the related art.

SUMMARY

According to an aspect of the invention, there is provided an electrostatic charge image developing toner including:

toner particles containing a binder resin and a white pigment, with a content of the white pigment being from 10% by weight to 50% by weight with respect to the entire toner particles, wherein, in a particle size distribution of a maximum Feret diameter of particles of the white pigment present in the toner particle, a ratio of particles of the white pigment having a maximum Feret diameter of 200 nm or more and less than 400 nm is 50% by number or more with respect to the entire particles of the white pigment, and wherein a maximum value of a frequency with respect to particles of the white pigment having a maximum Feret diameter of 650 nm or more and less than 1,000 nm is larger than a minimum value of a frequency with respect to particles of the white pigment having a maximum Feret diameter of 500 nm or more and less than 650 nm.

BRIEF DESCRIPTION OF THE DRAWINGS

Exemplary embodiments of the present invention will be described in detail based on the following figures, wherein.

DETAILED DESCRIPTION

Figure 1:
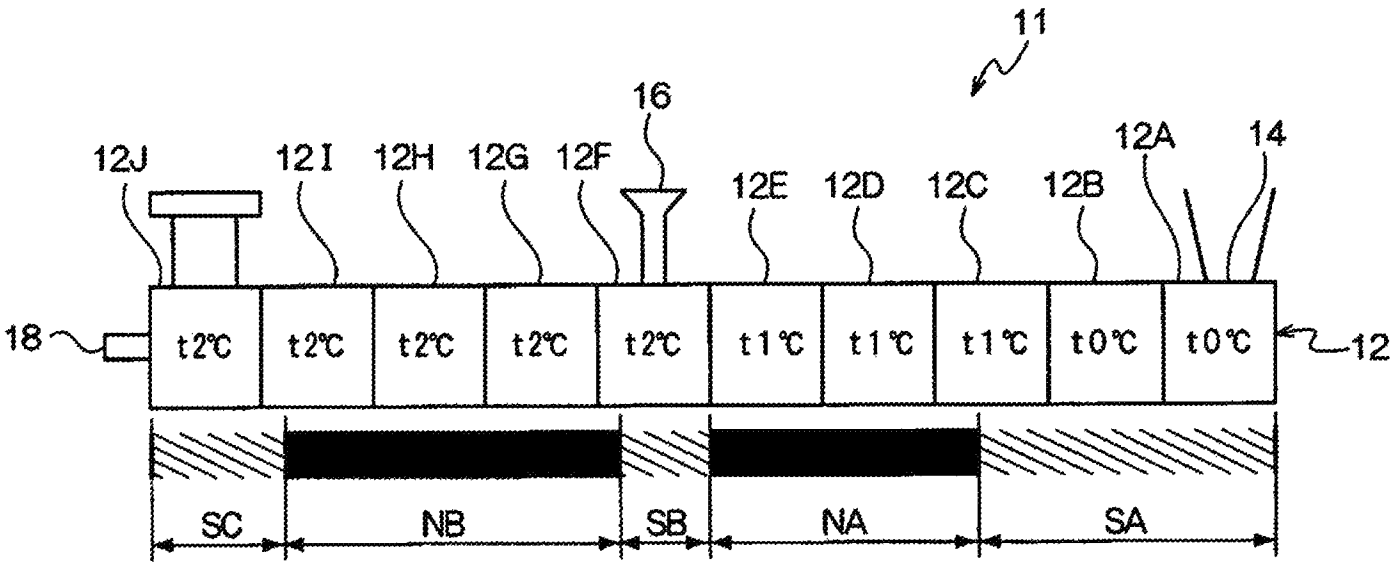
FIG. 1 is a diagram illustrating a state of a screw regarding an example of a screw extruder which is used to prepare toner according to the exemplary embodiment.

Hereinafter, the exemplary embodiment will be described.

Electrostatic Charge Image Developing Toner

An electrostatic charge image developing toner (also, simply referred to as "toner") according to the exemplary embodiment has a toner particle containing a binder resin and a white pigment, in which a content of the white pigment is from 10% by weight to 50% by weight with respect to the entire toner particles, and in a particle size distribution of a maximum Feret diameter of particles of the white pigment (hereinafter, simply referred to as "particle size distribution of white pigment particle" in some cases) present in the toner particle, the ratio of particles of the white pigment (hereinafter, referred to as "white pigment particle" in some cases) having a maximum Feret diameter of 200 nm or more and less than 400 nm is equal to or greater than 50% by number with respect to the entire particles of the white pigment, and a maximum value of a frequency with respect to particles having a maximum Feret diameter of 650 nm or more and less than 1,000 nm is larger than a minimum value of a frequency with respect to particles having a maximum Feret diameter of 500 nm or more and less than 650 nm.

Here, "maximum Feret diameter" means a maximum value of the distance between two parallel lines when a projected image of the white pigment particle is sandwiched by the two parallel lines.

Hereinafter, a white pigment particle having a maximum Feret diameter of 200 nm or more and less than 400 nm is referred to as a "small sized particle", a white pigment particle having a maximum Feret diameter of 500 nm or more and less than 650 nm is referred to as a "middle sized particle", and a white pigment particle having a maximum Feret diameter of 650 nm or more and less than 1,000 nm is referred to as a "large sized particle" in some cases.

Further, in the particle size distribution of the white pigment particle, a region in which the maximum Feret diameter is 200 nm or more and less than 400 nm is referred to a "small sized region", a region in which the maximum Feret diameter 500 nm or more and less than 650 nm is referred to a "middle sized region", and a region in which the maximum Feret diameter is 650 nm or more and less than 1,000 nm is referred to a "large sized region" in some cases.

The white toner for developing an electrostatic charge image according to the exemplary embodiment has the above-described configuration, and thus the deterioration of the toner fluidity is prevented. Although the reason is not clear, the following reasons may be presumed.

The white toner containing a white pigment is frequently used in a case where a large amount of toner is consumed so as to reduce the influence of a base color of the recording medium and improve color development by forming a colored toner image on a concealing layer formed of the white toner. As such, in the case of being used for the application in which a large amount of toner is consumed, the toner is supplied at a high speed, and thus particularly high fluidity is required.

In addition, particularly, in a case where a white pigment having high specific gravity is used, it tends to be solidified by the gravity, and thus further higher fluidity is required in many cases.

On the other hand, when the toner particle containing a white pigment is subjected to a mechanical load at the time of supplying the toner or at the time of stirring in a developing device, it may be cracked at an interface between the white pigment and the binder resin in the toner particle. In addition, when the toner particle is cracked, the resin surface of the inside of the toner particle is exposed, and thus the toner fluidity is deteriorated. Specifically, for example, in the toner in which the surface of the toner particle is coated with an external additive so as to improve the fluidity, the resin surface of the inside of the toner particle, which is not coated with the external additive, is exposed due to the crack of the toner particle, and thus it is difficult to exhibit an effect by the external additive, thereby deteriorating the toner fluidity.

In contrast, in the exemplary embodiment, in the particle size distribution of the white pigment particle, the ratio of the white pigment particles having a maximum Feret diameter of 200 nm or more and less than 400 nm is 50% by number or more with respect to the entire white pigment particles, and a maximum value of a frequency with respect to white pigment particles having a maximum Feret diameter of 650 nm or more and less than 1,000 nm is larger than a minimum value of a frequency with respect to white pigment particles having a maximum Feret diameter of 500 nm or more and less than 650 nm.

That is, in the exemplary embodiment, the majority of the white pigment particles present in the toner particle is occupied with the small sized particles, and the rest is mainly occupied with the large sized particles. For this reason, an area of an interface between the white pigment and the binder resin becomes smaller in the toner particle as compared with a case where the white pigment particles present in the toner particle is formed of the small sized particles only, and a case where the maximum Feret diameter is distributed in a wide range from the small sized region to the large sized region. In addition, when the area of the interface becomes smaller, even if the toner is subjected to the mechanical load, it is presumed that the toner particle is less likely to be cracked on the interface, and thus the deterioration of the toner fluidity due to the cracks of the toner particle is prevented.

In addition, in an image forming apparatus in which the toner of the exemplary embodiment is used, abnormal noise and clogging in the toner feeding path due to the deterioration of the toner fluidity is prevented when the deterioration of the toner fluidity is prevented.

As described above, in the exemplary embodiment, with such a configuration, it is presumed that the deterioration of the toner fluidity is prevented.

Further, in the exemplary embodiment, the ratio of the white pigment particles (that is, the small sized particle) having a maximum Feret diameter of 200 nm or more and less than 400 nm is 50% by number or more with respect to the entire white pigment particles, and thus as compared with a case where the ratio of the small sized particles is less than 50% by number with respect to the entire white pigment particles, the concealing properties of the image are improved by the white pigment. Although the reason is not clear, the following reasons may be presumed. The white pigment particle having a maximum Feret diameter of 200 nm or more and less than 400 nm contributes most to the concealing properties of the image.

In addition, among the toners of the exemplary embodiment, particularly, in the white toner which does not contain other coloring agents except for the white pigment, the concealing properties of the image are improved by the white pigment, and thus the whiteness of the image is improved.

Note that, from the viewpoint that the concealing properties of the image is improved (particularly, the whiteness is improved in a case of the white toner) by the white pigment, the ratio of the small sized particles is preferably 50% by number or more, is further preferably 60% by number or more, and is still further is preferably 70% by number or more.

In addition, as described in the exemplary embodiment, the content of the small sized particle is 50% by number or more with respect to the entire particles, and a method of obtaining toner particle having the maximum value of a frequency in the large sized region which is larger than the minimum value of a frequency in the middle sized region is not particularly limited; for example, the following method may be exemplified.

Specifically, a method in which a white pigment in which a primary particle has the maximum Feret diameter of the small sized region, and a white pigment in which a primary particle has the maximum Feret diameter of the large sized region are used in combination at the time of preparing the toner particle is exemplified. Further, the above-described toner particles are obtained by dispersing both white pigments in the toner particle as the primary particle so as to adjust the content ratio of the small sized particle to the large sized particle.

For example, at the time of preparing the toner particle, in the white pigment in which the primary particle has the maximum Feret diameter of the small sized region, only a portion of the white pigment is aggregated so as to be set as the large sized particle of an aggregate, the remaining portion of the white pigment is set as an isolated particle, and then both of them may be dispersed in the toner particle. Further, the toner particle is obtained by adjusting the ratio of the aggregates such that the white pigment particle (that is, the small sized particle) dispersed as the isolated particle is 50% by number or more.

Here, the "aggregate" is referred to as a particle which is present in a state where plural primary particles of the white pigment are aggregated, and the "isolated particle" is referred to as a primary particle of the white pigment which is independently present without contacting other primary particles".

Note that, at the time of preparing the toner particle, the method of dispersing the aggregate which is obtained by aggregating a portion of the white pigment in the toner particle is not particularly limited, and the specific examples thereof will be described below.

In the exemplary embodiment, the ratio of the white pigment particles (that is, the large sized particle) having the maximum Feret diameter of 650 nm or more and less than 1,000 nm is preferably from 5% by number to 30% by number with respect to the entire white pigments.

When the ratio of the large sized particles is within the above-described range, the deterioration of the toner fluidity is prevented as compared with a case where the ratio of the large sized particles is smaller than the above-described range. Although the reason is not clear, the following reasons may be presumed. When the ratio of the large sized particles is high, the area of the interface between the white pigment and the binder resin in the toner particle becomes smaller as described above, and thus cracks is less likely to occur in the interface, thereby preventing the toner fluidity from being deteriorated.

In addition, when the ratio of the large sized particles is within the above-described range, the concealing properties of the image are improved by the white pigment as compared with the case where the ratio exceeds the above-described range. Although the reason is not clear, the following reasons may be presumed. When the ratio of the large sized particles is prevented to be equal to or lower than 30% by number, a gap between the large sized particles is filled with a particle having the maximum Feret diameter which is smaller than that of the large sized particle, and thus the concealing properties of the image is improved by the white pigment.

Meanwhile, the ratio of the large sized particles is further preferably from 5% by number to 30% by number, and is still further preferably from 10% by number to 25% by number.

In the exemplary embodiment, the white pigment particle (that is, the large sized particle) having a maximum Feret diameter of 650 nm or more and less than 1,000 nm is preferably present in the form of an aggregate.

When the large sized particle is an aggregate, the concealing properties of the image are improved by the white pigment as compared with a case where the large sized particle is the isolated particle. Although the reason is not clear, the following reasons may be presumed. When the large sized particle is the aggregate, for example, in a step of forming an image (particularly, a fixing step of fixing a toner image), the large sized particle which is the aggregate is crushed and is present in a fixed image in a state of being a small sized particle which is likely to contribute to the concealing properties of the image.

In the exemplary embodiment, the ratio of the white pigment particle having a circularity of 0.85 or more is preferably 50% by number or more with respect to the entire white pigment particles present in the toner particles. When the ratio of the white pigment particle having a circularity of 0.85 or more is 50% by number or more, the deterioration of the toner fluidity is prevented as compared with a case where the ratio is less than 50% by number. Although the reason is not clear, the following reasons may be presumed. When there are a number of the white pigment particles having high circularity, the area of the interface between the white pigment and the binder resin becomes smaller in the toner particle, the cracks is less likely to occur on the interface, and thus the deterioration of the toner fluidity due to the cracks is prevented.

Further, from the viewpoint that the deterioration of the toner fluidity is prevented, the ratio of the white pigment particles having a circularity of 0.85 or more is further preferably 50% by number or more, and is still further preferably 70% by number or more, with respect to the entire white pigment particles present in the toner particle.

Further, from the viewpoint that the deterioration of the toner fluidity is prevented, the ratio of the white pigment particles having a circularity of 0.90 or more is preferably 20% by number or more, further preferably 30% by number or more, and still further preferably 40% by number or more, with respect to the entire white pigment particles present in the toner particle.

The maximum Feret diameter and the circularity of the white pigment are obtained as follows.

Specifically, first, toner which is a target to be measured is mixed and embedded in an epoxy resin, and the epoxy resin is solidified. An obtained solidified matter is cut by using an ultra microtome device (ULTRACUT UCT manufactured by Leica Inc.) so as to manufacture a flake sample having a thickness of 100 nm.

An SEM image is obtained by observing a cross section of the obtained flake sample at 10,000× observation magnification by using a scanning electron microscope (FE-SEM, manufactured by Hitachi High-Technologies Corporation, model No.: S-4800).

After noises in the obtained SEM image are removed through Despeckle treatment from Process menu of image analysis software (developed by Wayne Rashand, model No.: ImageJ bundled with 32-bit Java 1.6.0_24 ver.), the SEM image is analyzed and binarized under the condition of 20% of luminance threshold, and a contour of the white pigment particle present in the toner particle is extracted.

Note that, among the white pigment particles, in which the contour is extracted, in the SEM image, a collected member in which the plural primary particles contact each other is referred to as an "aggregate", the primary particle which is independently present without contacting other primary particle is referred to as an "isolated particle".

Next, the maximum Feret diameter of the white pigment particle in which the contour is extracted is calculated. Then, regarding 1,000 particles having a maximum Feret diameter in a range of 10 nm to 2,000 nm, the range (in a range of 10 nm to 2,000 nm) of the maximum Feret diameter of a target to be measured is divided by 50 nm, and a distribution of the number of the particles (that is, a frequency) in each section of the maximum Feret diameter is calculated so as to obtain a particle size distribution.

In addition, among the white pigment particles in which the contour is extracted, the circularity of each of 1,000 particles having a maximum Feret diameter in a range of 10 nm to 2,000 nm is calculated by the following equation. Here, "circumference length of circle equivalent diameter" in the following equation means a circumference length of a true circle having the same area as that of a projected image of each particle, "circumference length of projected image" means a circumference length of the projected image of each particle.

circularity=(circumference length of circle equivalent diameter)/(circumference length of projected image) Equation:

Hereinafter, the toner according to the exemplary embodiment will be described in detail.

The toner in the exemplary embodiment is formed of toner particles, and an external additive if necessary.

Toner Particle

The toner particle is formed of a binder resin, and if necessary, a coloring agent, a release agent, and other additives.

Binder Resin

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and a modified rosin, a mixture thereof with the above-described vinyl resins, or a graft polymer obtained by polymerizing a vinyl monomer with the coexistence of such non-vinyl resins.

These binder resins may be used singly or in combination of two or more types thereof.

As the binder resin, the polyester resin is preferably used.

Examples of the polyester resin include a well-known polyester resin.

Examples of the polyester resin include condensation polymers of polyvalent carboxylic acids and polyol. A commercially available product or a synthesized product may be used as the polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may be used in combination together with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more types thereof.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are further preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

The glass transition temperature (Tg) of the polyester resin is preferably from 50° C. to 80° C., and further preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K 7121-1987 "testing methods for transition temperatures of plastics".

The weight average molecular weight (Mw) of the polyester resin is preferably from 5,000 to 1,000,000, and is further preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and is further preferably from 2 to 60.

The weight average molecular weight and the number average molecular weight are measured by gel permeation chromatography (GPC). The molecular weight measurement by GPC is performed using GPC•HLC-8120 GPC, manufactured by Tosoh Corporation as a measuring device, Column TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to prepare the polyester resin. Specific examples thereof include a method of conducting a reaction at a polymerization temperature set to be from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Here, as the polyester resin, a modified polyester resin may be also exemplified in addition to the above unmodified polyester resin. The modified polyester resin means a polyester resin in which a bonding group other than an ester bond is present, or a polyester resin to which a resin component different from a polyester resin component is bonded through a covalent bond or a ionic bond. Examples of the modified polyester resin include a polyester resin in which a functional group such as an isocyanate group which reacts with an acid group or a hydroxyl group is introduced to a terminal end, and a resin which reacts with an active hydrogen compound and the terminal end thereof is modified.

As the modified polyester resin, a urea modified polyester resin is particularly preferable. When the urea modified polyester resin is contained as the binder resin, it becomes easier to prevent the reduction of image density of the image formed in a region which is a non image portion in the previous image forming cycle. The reason for this is that cross linking of the urea modified polyester resin and a chemical structure (specifically, chemical properties in the physical properties of resin by crosslinking of the urea modified polyester resin, and affinity between a bonding group having polarity and a fatty acid metal salt particle having polarity), adhesion between the toner particle, the fatty acid metal salt particle, and the abrasive particle tends to be improved, and thus it is easy to control the range of the flaking amount ratio of the fatty acid metal salt particle to the abrasive particle. From this aspect, the content of the urea modified polyester resin is preferably from 5% by weight to 50% by weight, and is further preferably from 7% by weight to 20% by weight, with respect to the entire binder resin.

As the urea modified polyester resin, a urea modified polyester resin which is obtained by the reaction (at least one of the crosslinking reaction and the elongation reaction) between a polyester resin (polyester prepolymer) having an isocyanate group and an amine compound may be employed. Note that, a urea bond and a urethane bond may be contained in the urea modified polyester resin.

Examples of the polyester prepolymer having an isocyanate group include a prepolymer, which is polyester corresponding to a condensation polymer of polyvalent carboxylic acids and polyol, obtained by reacting a polyvalent isocyanate compound with polyester having active hydrogen. Examples of a group having active hydrogen of polyester include a hydroxyl group (an alcholic hydroxyl group and a phenolic hydroxyl group), an amino group, a carboxyl group, and a mercapto group, and an alcholic hydroxyl group is preferably used.

In the polyester prepolymer having an isocyanate group, as the polyvalent carboxylic acids and polyol, the same compounds as the polyvalent carboxylic acids and polyol described in the polyester resin may be exemplified.

Examples of a polyvalent isocyanate compound include aliphatic polyisocyanate (tetramethylene diisocyanate, hexamethylene diisocyanate, 2,6-diisocyanatomethyl caproate, and the like); alicyclic polyisocyanate (isophorone diisocyanate, cyclohexylmethane diisocyanate, and the like); Aromatic diisocyanate (tolylene diisocyanate, diphenylmethane diisocyanate, and the like); aromatic-aliphatic diisocyanate ($\alpha,\alpha,\alpha',\alpha'$-tetramethylxylylene diisocyanate, and the like); isocyanurates; and compounds obtained by blocking the polyisocyanate with a blocking agent such as a phenol derivative, oxime, caprolactam or the like.

The polyvalent isocyanate compound may be used alone or two or more types thereof may be used in combination.

When the ratio of the polyvalent isocyanate compound is assumed to be the equivalent ratio [NCO]/[OH] of an isocyanate group [NCO] to a hydroxyl group [OH] of a polyester prepolymer having a hydroxyl group, it is preferably from 1/1 to 5/1, is further preferably from 1.2/1 to 4/1, and is still further preferably from 1.5/1 to 2.5/1. When the ratio of [NCO]/[OH] is set to be from 1/1 to 5/1, it becomes easier to prevent the reduction of image density of the image formed in a region which is a non image portion in the previous image forming cycle. In addition, when the ratio of [NCO]/[OH] is equal to or lower than 5, deterioration of the low-temperature fixability is easily prevented.

In the polyester prepolymer having an isocyanate group, the content of a component derived from the polyvalent isocyanate compound is preferably from 0.5% by weight to 40% by weight, is further preferably from 1% by weight to 30% by weight, and is still further preferably from 2% by weight to 20% by weight, with respect to the entire polyester prepolymer having an isocyanate group. When the content of the component derived from polyvalent isocyanate is set to be from 0.5% by weight to 40% by weight, it becomes easier to prevent the reduction of image density of the image formed in a region which is a non image portion in the previous image forming cycle. Note that, when the content of the component derived from polyvalent isocyanate is set to be equal to or lower than 40% by weight, the deterioration of the low-temperature fixability is easily prevented.

The number of the isocyanate groups contained per molecule of the polyester prepolymer having an isocyanate group is preferably 1 or more on average, is further preferably from 1.5 to 3 on average, and is still further preferably from 1.8 to 2.5 on average. When the number of the isocyanate groups is set to be one or more per molecule, the molecular weight of the urea modified polyester resin after reaction is increased, and thus it becomes easier to prevent the reduction of image density of the image formed in a region which is a non image portion in the previous image forming cycle.

Examples of the amine compound which reacts with the polyester prepolymer having an isocyanate group include diamine, trivalent or higher polyamine, amino alcohol, amino mercaptan, amino acid, and compounds obtained by blocking these amino groups.

Examples of diamine include aromatic diamines (phenylenediamine, diethyltoluenediamine, 4,4'diaminodiphenylmethane, and the like); alicyclic diamines (4,4'-diamino-3,3'dimethyldicyclohexylmethane, diamine cyclohexane, isophorone diamine, and the like); and aliphatic diamines (ethylenediamine, tetramethylenediamine, hexamethylenediamine, and the like).

Examples of the trivalent or higher polyamine include diethylene triamine and triethylene tetramine.

Examples of the amino alcohol include ethanolamine and hydroxyethylaniline.

Examples of the amino mercaptan include aminoethyl mercaptan, and aminopropyl mercaptan.

Examples of the amino acid include aminopropionic acid and aminocaproic acid.

Examples of the compounds obtained by blocking the above-described amino groups include a ketimine compound obtained from an amine compound such as diamine, trivalent or higher polyamine, amino alcohol, amino mercaptan, and amino acid, and a ketone compound (acetone, methyl ethyl ketone, methyl isobutyl ketone, and the like), and an oxazoline compound.

Among the amine compounds, the ketimine compound is preferable.

The amine compounds may be used alone, or two or more types thereof may be used in combination.

Note that, the urea modified polyester resin may be a resin in which the reaction (at least one reaction of a crosslinking reaction and an elongation reaction) of a polyester resin (a polyester prepolymer) having an isocyanate group and an amine compound is adjusted by using a terminator (hereinafter, referred to as a "crosslinking or elongation reaction terminator" in some cases) for terminating at least one reaction of the crosslinking reaction and the elongation reaction, and the molecular weight after reaction is adjusted.

Examples of the crosslinking or elongation reaction terminator, monoamines (such as diethylamine, dibutylamine, butylamine, and laurylamine), and compounds (such as a ketimine compound) obtained by blocking the monoamines.

Regarding the ratio of an amine compound, the equivalent ratio [NCO]/[NHx] of an isocyanate group [NCO] in the polyester prepolymer having an isocyanate group to an amino group [NHx] in amines is preferably from 1/2 to 2/1, is further preferably from 1/1.5 to 1.5/1, and is still further preferably from 1/1.2 to 1.2/1. When the equivalent ratio of [NCO]/[NHx] is within the above-described range, the molecular weight of the urea modified polyester resin after reaction is increased, and thus it becomes easier to prevent the reduction of image density of the image formed in a region which is a non image portion in the previous image forming cycle.

Note that, a glass transition temperature of the urea modified polyester resin is preferably from 40° C. to 65° C., and is further preferably from 45° C. to 60° C. The number average molecular weight (Mn) is preferably from 2,500 to 50,000, and is further preferably from 2,500 to 30,000. The weight average molecular weight (Mw) is preferably from 10,000 to 500,000, and is further preferably from 30,000 to 100,000.

The content of the binder resin is preferably from 40% by weight to 95% by weight, is further preferably from 50% by weight to 90% by weight, and is still further preferably from 60% by weight to 85% by weight, with respect to the entire toner particles.

Coloring Agent

As a coloring agent, at least a white pigment is used.

Examples of the white pigment include an inorganic pigment (for example, heavy calcium carbonate, light calcium carbonate, titanium dioxide, aluminum hydroxide, satin white, talc, calcium sulfate, barium sulfate, zinc oxide, magnesium oxide, magnesium carbonate, amorphous silica, colloidal silica, white carbon, kaolin, calcined kaolin, delaminated kaolin, aluminosilicate, sericite, bentonite, and smectite), and an organic pigment (for example, a polystyrene resin particle and a urea-formaline resin particles).

The white pigment may be used alone or two or more types thereof may be used in combination.

As the white pigment, a white pigment which is subjected to a surface treatment if necessary may be used, or a dispersion may be used in combination.

The content of the white pigment is from 10% by weight to 50% by weight, is preferably from 25% by weight to 50% by weight, and is further preferably from 32% by weight to 50% by weight with respect to the entre toner particles, from the viewpoint of the obtained concealing properties of the image and granulation property of the toner particles.

Note that, coloring agents other than the white pigment may be contained to the extent that the effect in the exemplary embodiment is not impaired. In this regard, in a case where the toner of the exemplary embodiment is used as a white toner, the content of the coloring agent other than the white pigment is less than 1% by weight, is further preferably less than 0.5% by weight, and is still further preferably 0% by weight with respect to the entire toner particles, from the viewpoint of improving the whiteness of an image.

Examples of the coloring agent other than the white pigment includes various types of pigments such as carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The coloring agents other than the white pigment may be used singly or in combination of two or more types thereof.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and is further preferably from 60° C. to 100° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The content of the release agent is preferably from 1 weight % to 20 weight %, and is further preferably from 5 weight % to 15 weight % with respect to the entire toner particles.

Other Additives

Examples of other additives include well-known additives such as a magnetic material, a charge-controlling agent, and an inorganic powder. These additives are contained in the toner particle as internal additives.

Properties of Toner Particles

The toner particles may be toner particles having a single-layer structure, or toner particles having a so-called core•shell structure composed of a core (core particle) and a coating layer (shell layer) coated on the core.

Here, the toner particles having a core shell structure is preferably composed of, for example, a core containing a binder resin, and if necessary, other additives such as a coloring agent and a release agent and a coating layer containing a binder resin.

The volume average particle diameter (D50v) of the toner particles is preferably from 2 μm to 10 μm, and is further preferably from 4 μm to 8 μm.

Various average particle diameters and various particle diameter distribution indices of the toner particles are measured using a COULTER MULTISIZER II (manufactured by Beckman Coulter, Inc.) and ISOTON-II (manufactured by Beckman Coulter, Inc.) as an electrolyte.

In the measurement, a measurement sample from 0.5 mg to 50 mg is added to 2 ml of a 5% aqueous solution of surfactant (preferably sodium alkylbenzene sulfonate) as a dispersing agent. The obtained material is added to the electrolyte from 100 ml to 150 ml.

The electrolyte in which the sample is suspended is subjected to a dispersion treatment using an ultrasonic disperser for one minute, and a particle diameter distribution of particles having a particle diameter of from 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

The average circularity of the toner particles is preferably from 0.94 to 1.00, and is further preferably from 0.95 to 0.98.

The average circularity of the toner particles is calculated by (circumference length of circle equivalent diameter)/(circumference length) [(circumference length of circle having the same projection area as that of particle image)/(circumference length of particle projected image)]. Specifically, the value is measured by using the following method.

The average circularity of the toner particles is calculated by using a flow particle image analyzer (FPIA-2100 manufactured by Sysmex Corporation) which first, suctions and collects the toner particles to be measured so as to form flat flow, then captures a particle image as a static image by instantaneously emitting strobe light, and then performs image analysis of the obtained particle image. 3,500 particles are sampled at the time of calculating the average circularity.

In a case where the toner contains an external additive, the toner (the developer) to be measured is dispersed in the water containing a surfactant, and then the water is subjected to an ultrasonic treatment so as to obtain the toner particles in which the external additive is removed.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

Surfaces of the inorganic particles as an external additive are preferably treated with a hydrophobizing agent. The hydrophobizing treatment is performed by, for example, dipping the inorganic particles in a hydrophobizing agent. The hydrophobization treating agent is not particularly limited and examples thereof include a silane coupling agent, silicone oil, a titanate coupling agent, and an aluminum coupling agent. These may be used alone or in combination of two or more kinds thereof.

Generally, the amount of the hydrophobization treating agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning aid (for example, metal salts of higher fatty acids typified by zinc stearate, and particles having fluorine high molecular weight polymer).

The amount of the external additive is, for example, preferably from 0.01 weight % to 5 weight %, and is further preferably from 0.01 weight % to 2.0 weight % with respect to the toner particles.

Method of Preparing Toner

Next, the method of preparing the toner will be described.

The toner of the exemplary embodiment is obtained by additionally adding the external additive to the toner particles after preparing the toner particles.

The toner particles may be prepared by using any one of a drying method (for example, a kneading and pulverizing method) and a wetting method (for example, an aggregation and coalescence method, a suspension polymerization method, and a dissolution suspension method). The method of preparing the toner particles is not particularly limited, and well-known method may be employed.

Among them, the toner particles may be obtained by using the aggregation and coalescence method.

Aggregation and Coalescence Method

Specifically, for example, in a case where the toner particles are prepared by using the aggregation and coalescence method, the toner particles are prepared through the following steps.

The steps include a step (a resin particle dispersion preparing step) of preparing a resin particle dispersion in which resin particles constituting the binder resin are dispersed and a coloring agent particle dispersion in which particles of the coloring agent containing a white pigment (hereinafter, also referred to as "a coloring agent particle") are dispersed, a step (an aggregated particle forming step) of forming aggregated particles by aggregating the resin particles and coloring agent particles (other particles if necessary), in the dispersion in which the resin particle dispersion and the coloring agent particle dispersion are mixed with each other (in the dispersion in which other particle dispersions are mixed, if necessary); and a step (a coalescence step) of coalescing aggregated particles by heating an aggregated particle dispersion in which aggregated particles are dispersed so as to form toner particles.

Hereinafter, the respective steps will be described in detail.

In the following description, a method of obtaining toner particles including the release agent will be described; however, the release agent are used if necessary. Other additives other than the coloring agent and the release agent may also be used.

Dispersion Preparing Step

First, a resin particle dispersion in which the resin particles corresponds to the binder resins are dispersed, a coloring agent particle dispersion in which coloring agent particles are dispersed, and a release agent particle dispersion in which the release agent particles are dispersed are prepared, for example.

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used singly or in combination of two or more types thereof.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol. Among them, anionic surfactants and cationic surfactants are particularly preferable. Nonionic surfactants may be used in combination with anionic surfactants or cationic surfactants.

The surfactants may be used singly or in combination of two or more types thereof.

Regarding the resin particle dispersion, as a method of dispersing the resin particles in the dispersion medium, a common dispersing method using, for example, a rotary shearing-type homogenizer, or a ball mill, a sand mill, or a Dyno mill including media is exemplified. Depending on the type of the resin particles, the resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by adding an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, further preferably from 0.08 μm to 0.8 μm, and still further preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is measured as a volume average particle diameter D50v. The volume average particle diameter of the particles in other dispersion liquids is also measured in the same manner.

The content of the resin particles contained in the resin particle dispersion is, for example, preferably from 5% by weight to 50% by weight, and further preferably from 10% by weight to 40% by weight.

For example, the coloring agent particle dispersion and the release agent particle dispersion are also prepared in the same manner as in the case of the resin particle dispersion. That is, the resin particles in the resin particle dispersion are the same as the particles of the coloring agent dispersed in the coloring agent dispersion, and the release agent particle dispersed in the release agent particle dispersion, in terms of the volume average particle diameter, the dispersion medium, the dispersing method, and the content of the particles in the resin particle dispersion.

Aggregated Particle Forming Step

Next, the resin particle dispersion, the coloring agent particle dispersion, and the release agent particle dispersion are mixed with each other.

The resin particles, the coloring agent particles, and the release agent particle are heterogeneously aggregated in the mixed dispersion, thereby forming aggregated particles having a diameter near a target toner particle diameter and including the resin particles, the coloring agent particles, and the release agent particles.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature of a glass transition temperature of the resin particles (specifically, for example, in a range of (glass transition temperature—30° C.) to (glass transition temperature—10° C.) of the resin particles) to aggregate the particles dispersed in the mixed dispersion, thereby forming the aggregated particles.

In the aggregated particle forming step, for example, the aggregating agent may be added at room temperature (for example, 25° C.) while stirring the mixed dispersion using a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, a divalent or more metal complex. Particularly, when a metal complex is used as the aggregating agent, the amount of the surfactant used is reduced and charging characteristics are improved.

An additive for forming a bond of metal ions as the aggregating agent and a complex or a similar bond may be used, if necessary. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably from 0.01 parts by weight to 5.0 parts by weight, and is further preferably 0.1 parts by weight or more and less than 3.0 parts by weight, with respect to 100 parts by weight of resin particle.

Coalescence Step

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to perform the coalesce on the aggregated particles and form toner particles.

The toner particles are obtained through the foregoing steps.

Note that, the toner particles may be obtained through a step of forming a second aggregated particles in such a manner that an aggregated particle dispersion in which the aggregated particles are dispersed is obtained, the aggregated particle dispersion and a resin particle dispersion in which resin particles are dispersed are mixed, and the mixtures are aggregated so that the resin particles are further attached on the surface of the aggregated particles, and a step of forming the toner particles having a core/shell structure by heating a second aggregated particle dispersion in which the second aggregated particles are dispersed, and coalescing the second aggregated particles.

Here, after the coalescence step ends, the toner particles formed in the solution are subjected to a washing step, a solid-liquid separation step, and a drying step, that are well known, and thus dry toner particles are obtained.

In the washing step, displacement washing using ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

In addition, in a case where the toner particles are prepared by using the aggregation and coalescence method, a method, in which only a portion of the white pigment is aggregated so as to be set as a large sized particle, the remaining portion of the white pigment is set as a small sized particle which is an isolated particle, and the large sized particle and the small sized particle are dispersed in the toner particle, is not particularly limited, and the following methods are exemplified. Examples thereof include a method including a first aggregation step of forming an aggregate of white pigment particles by using a first aggregating agent, and a second aggregation step of forming aggregated particles which contain resin particles, aggregates of the white pigment particles, and primary particles (that is, an isolated particle) of the white pigment particle by using a second aggregating agent.

Note that, the first aggregation step may be performed in the above-described aggregated particle forming step, or may be performed in a dispersion preparing step.

In a case where the first aggregation step is performed in the aggregated particle forming step, for example, the aggregate of the white pigment particles is formed by adding the first aggregating agent into a mixed dispersion obtained by mixing a resin particle dispersion, a coloring agent particle dispersion and a white pigment particle, and a release agent particle dispersion if necessary. Note that, the first aggregating agent may be added into the entire mixed dispersion, or the aggregate of the white pigment particles may be formed by adding the first aggregating agent into a portion of the mixed dispersion, and then mixed with the remaining portion of the mixed dispersion to which the first aggregating agent is not added.

In addition, in the second aggregation step, the aggregated particles containing the resin particles, the aggregates of the white pigment particles, and the isolated particles of the white pigment particle are formed by adding the second aggregating agent into the mixed dispersion in which the aggregate of the white pigment particles is formed.

Here, in the first aggregation step performed in the aggregated particle forming step, the aggregate of the white pigment particles is formed in the mixed dispersion; however, as a method of selectively aggregating the white pigment particles under the presence of the resin particles, the following method is exemplified, for example.

Specifically, in a case where the resin particle is dispersed by using an anionic surfactant at the time of preparing the resin particle dispersion, a cationic surfactant which is a surfactant having a polarity opposite to that of the surfactant used for preparing the resin particle dispersion is used to prepare the coloring agent particle dispersion. In addition, when an anionic aggregating agent (that is, an aggregating agent having a polarity opposite to that of the surfactant used for preparing the coloring agent particle dispersion) is used as the first aggregating agent, the white pigment particles in the mixed dispersion are selectively aggregated, and thereby the aggregate of the white pigment particles are formed.

In addition, as the second aggregating agent, an aggregating agent (in the case of the above-described specific example, the cationic aggregating agent) having a polarity opposite to that of the first aggregating agent is preferably used. With this, in a second aggregating step, the resin particle, the aggregate of the white pigment particles, the primary particle (that is, the isolated particle) of the white pigment particle, which remains without being aggregated in the first aggregation step, and other particles if necessary are aggregated so as to form an aggregated particle.

Note that, in a case where the cationic surfactant is used to prepare the resin particle dispersion, it is preferable that the anionic surfactant is used for preparing the coloring agent particle dispersion, the cationic aggregating agent is used as the first aggregating agent, and the anionic aggregating agent is used as the second aggregating agent.

Specific examples of the anionic aggregating agent include polyacrylamide, polymethacrylamide, polyoxyethylene, and polyoxypropylene.

Specific examples of the cationic aggregating agent include polyaluminum chloride, sodium chloride, aluminum sulfate, calcium sulfate, ammonium sulfate, aluminum nitrate, silver nitrate, copper sulfate, sodium carbonate, polyaluminum hydroxide, and calcium polysulfide.

The particle size distribution of the white pigment particle (that is, the maximum Feret diameter of the aggregate, the ratio of the small sized particle to the large sized particle, and the like) in the toner particle is controlled by being adjusted under the conditions of the first aggregation step (for example, keeping time, temperature, and pH) in addition to the types and adding amount of the first aggregating agents. Further, in a case where a portion of the mixed dispersion to which the first aggregating agent is added is mixed with a remaining portion of the mixed dispersion to which the first aggregating agent is not added, the particle size distribution of the white pigment particle may be controlled by the ratio of the mixed dispersion to which the first aggregating agent is added to the mixed dispersion to which the first aggregating agent is not added.

In a case where the first aggregation step is performed in the dispersion preparing step, for example, a white pigment aggregate dispersion in which the aggregate of the white pigment particles is dispersed is prepared by adding the first aggregating agent to a portion of the coloring agent particle dispersion so as to aggregate the white pigment particles before mixing the resin particle dispersion with the coloring agent particle dispersion. After that, in the aggregated particle forming step, a mixed dispersion is prepared by mixing the resin particle dispersion, the white pigment aggregate dispersion, the coloring agent particle dispersion to which the first aggregating agent is not added, and other dispersions if necessary. In addition, the second aggregation step in which the resin particle, the aggregate of the white pigment particles, the primary particle of the white pigment particle, and other particles if necessary are aggregated is performed by adding the second aggregating agent to the mixed dispersion so as to obtain an aggregated particle.

Note that, the first aggregating agent and the second aggregating agent which are used in a case where the first aggregation step is performed in the dispersion preparing step are the same as the first aggregating agent and the second aggregating agent which are used in a case where the first aggregation step is performed in the above-described aggregated particle forming step.

In other words, in a case where the anionic surfactant is used to prepare the resin particle dispersion, and the cationic surfactant is used to prepare the coloring agent particle dispersion, the anionic aggregating agent is used as the first aggregating agent, and the cationic aggregating agent is used as the second aggregating agent.

Further, in the same way, the particle size distribution of the white pigment particle (that is, the maximum Feret diameter of the aggregate, the ratio of the small sized particle to the large sized particle, and the like) present in the toner particle is controlled by being adjusted under the conditions of the first aggregation step (for example, keeping time, temperature, and pH) in addition to the types and adding amount of the first aggregating agents.

Dissolution Suspension Method

Next, a dissolution suspension method will be described.

The toner particle containing a urea modified polyester resin as a binder resin may be obtained by the following dissolution suspension method. Note that, a method of obtaining a toner particle containing an unmodified polyester resin and a urea modified polyester resin as a binder resin will described; however, the toner particle may contain only the urea modified polyester resin as a binder resin.

Oil Phase Liquid Preparing Step

An oil phase liquid in which a toner particle material containing an unmodified polyester resin, a polyester prepolymer having an isocyanate group, an amine compound, a brilliant pigment, and a release agent is dissolved or dispersed in an organic solvent is prepared (oil phase liquid preparing step). In the oil phase liquid preparing step, the toner particle material is dissolved or dispersed in the organic solvent so as to obtain a mixed solution of the toner material.

Examples of the method of preparing the oil phase liquid include 1) a method of preparing the oil phase liquid by collectively dissolving or dispersing toner materials in an organic solvent, 2) a method of preparing the oil phase liquid by kneading a toner material in advance, and then dissolving or dispersing the kneaded material in an organic solvent, 3) a method of preparing the oil phase liquid by dissolving an unmodified polyester resin, a polyester prepolymer having an isocyanate group, and an amine compound in an organic solvent, and then dissolving a brilliant pigment and a release agent to the organic solvent, 4) a method of preparing the oil phase liquid by dispersing the brilliant pigment and the release agent in an organic solvent, and then dispersing an unmodified polyester resin, a polyester prepolymer having an isocyanate group, and an amine compound in the organic solvent, 5) a method of preparing the oil phase liquid by dissolving or dispersing toner particle materials (an unmodified polyester resin, a brilliant pigment, and a release agent) other than a polyester prepolymer having an isocyanate group and an amine compound in an organic solvent, and then dissolving the polyester prepolymer having an isocyanate group and the amine compound in the organic solvent, and 6) a method of preparing the oil phase liquid by dissolving or dispersing toner particle materials (an unmodified polyester resin, a brilliant pigment, and a release agent) other than a polyester prepolymer having an isocyanate group or an amine compound in an organic solvent, and then dispersing the polyester prepolymer having an isocyanate group or the amine compound in the organic solvent. Note that, the method of preparing the oil phase liquid is not limited to the above-described examples.

Examples of the organic solvent of the oil phase liquid include an ester solvent such as methyl acetate and ethyl acetate; a ketone solvent such as methyl ethyl ketone and methyl isopropyl ketone; an aliphatic hydrocarbon solvent such as hexane or cyclohexane; and a halogenated hydrocarbon solvent such as dichloromethane, chloroform, and trichloroethylene. The organic solvents which are used for dissolving the binder resin have the ratio which is preferably from 0% by weight to 30% by weight with respect to water, and a boiling point of which is preferably equal to or lower than 100° C. Among the organic solvents, ethyl acetate is preferably used.

Suspension Liquid Preparing Step

Next, a suspension liquid is prepared by dispersing the obtained oil phase liquid in an aqueous phase liquid (suspension liquid preparing step).

Then, the reaction of the polyester prepolymer having an isocyanate group and the amine compound is performed at the time of preparing the suspension liquid. In addition, a urea modified polyester resin is formed by the reaction. Note that, the reaction is accompanied by at least one reaction of crosslinking reaction and elongation reaction of the molecular chain. Further, the reaction of the polyester prepolymer having an isocyanate group and the amine compound may be perform together with an organic solvent removing step to be described below.

Here, the conditions of the reaction are selected by the reactivity of an isocyanate group structure included in a polyester prepolymer and an amine compound. As one example, a reaction time is preferably from 10 minutes to 40 hours, and is preferably from 2 hours to 24 hours. A reaction temperature is preferably from 0° C. to 150° C., and is preferably from 40° C. to 98° C. Note that, in the formation of the urea modified polyester resin, well-known catalysts (dibutyltin laurate, dioctyltin laurate, and the like) may be used if necessary. That is, a catalyst may be added to an oil phase liquid or a suspension liquid.

Examples of the aqueous phase liquid include an aqueous phase liquid in which a particle dispersing agent such as an organic particle dispersing agent and an inorganic particle dispersing agent are dispersed in an aqueous medium. Examples of the aqueous phase liquid further include an aqueous phase liquid in which the particle dispersing agent is dispersed in the aqueous medium, and a polymer dispersing agent is dissolved in the aqueous medium. Note that, well-known additives such as a surfactant may be added to the aqueous phase liquid.

Examples of the aqueous medium include water (typically, ion exchange water, distilled water, and pure water). The aqueous medium may be a solvent including water and an organic solvent such as alcohols (such as methanol, isopropyl alcohol, and ethylene glycol), dimethylformamide, tetrahydrofuran, cellosolves (such as methyl cellosolve), and lower ketones (acetone and methyl ethyl ketone).

Examples of the organic particle dispersing agent include hydrophilic organic particle dispersing agent. Examples of the organic particle dispersing agent include particles such as a poly(meth)acrylic acid alkyl ester resin (for example, polymethyl methacrylate resin), a polystyrene resin, and a poly (styrene-acrylonitrile) resin. Examples of the organic particle dispersing agent include a styrene acrylic resin particle.

Examples of the inorganic particle dispersing agent include hydrophilic inorganic particle dispersing agent. Specific examples of the inorganic particle dispersing agent include particles such as silica, alumina, titania, calcium carbonate, magnesium carbonate, tricalcium phosphate, clay, diatomaceous earth, and bentonite, and particles of carbonate are preferable. The inorganic particle dispersing agent may be used alone or two or more types thereof may be used in combination.

The surface of the particle dispersing agent may be surface-treated by using a polymer having a carboxyl group.

Examples of the polymer having the carboxyl group include a copolymer of at least one selected from salts (alkali metal salt, alkaline earth metal salt, ammonium salt, amine salt, and the like) obtained by neutralizing carboxyl groups of α,β-monoethylenically unsaturated carboxylic acids or α,β-monoethylenically unsaturated carboxylic acids with alkali metals, alkaline earth metals, ammonium, amines, and the like, and an α,β-monoethylenically unsaturated carboxylic acid ester. Examples of the polymer having the carboxyl group include salts (alkali metal salt, alkaline earth metal salt, ammonium salt, amine salt, and the like) obtained by neutralizing carboxyl groups of the copolymer of α,β-monoethylenically unsaturated carboxylic acid and α,β-monoethylenically unsaturated carboxylic acid ester with alkali metals, alkaline earth metals, ammonium, amines, and the like. The polymer having the carboxyl group may be used alone or two or more types thereof may be used in combination.

Representative examples of the α,β-monoethylenically unsaturated carboxylic acids include α,β-unsaturated mono-carboxylic acids (acrylic acid, methacrylic acid, and crotonic acid), and α,β-unsaturated dicarboxylic acids (maleic acid, fumaric acid, and itaconic acid). In addition, representative examples of α,β-monoethylenically unsaturated carboxylic acid ester include (meth)acrylic acid alkyl esters, (meth) acrylate having an alkoxy group, (meth)acrylate having a cyclohexyl group, (meth)acrylate having a hydroxy group, and polyalkylene glycol mono(meth)acrylate.

As the polymer dispersing agent, a hydrophilic polymer dispersing agent is exemplified. Specific examples of the polymer dispersing agent include a polymer dispersing agent (for example, water-soluble cellulose ethers such as carboxymethyl cellulose and carboxyethyl cellulose) having a carboxyl group without a lipophilic group (a hydroxypropoxy group, a methoxy group, and the like).

Solvent Removing Step

Next, an organic solvent is removed from the obtained suspension liquid so as to obtain a toner particle dispersion (solvent removing step). In the solvent removing step, the organic solvent, which is contained in a liquid droplet of an aqueous phase liquid dispersed in the suspension liquid, is removed so as to form a toner particle. Removing the organic solvent from the suspension liquid may be perform right after the suspension liquid preparing step, or may be performed in one minute or more after the suspension liquid preparing step.

In the solvent removing step, the organic solvent may be removed from the suspension liquid by cooling or heating the obtained suspension liquid at a temperature in a range of 0° C. to 100° C.

As the specific method of removing the organic solvent, the following method is exemplified.

(1) A method of forcibly updating a gas phase on the surface of the suspension liquid by blowing an air stream to the suspension liquid. In this case, the gas may be blown into the suspension liquid.

(2) A method of reducing pressure. In this case, a gas phase on the surface of the suspension liquid may be forcibly updated by filling of the gas, and the gas may be blown into the suspension liquid.

The toner particles are obtained through the foregoing steps.

Here, after completing of the solvent removing step, the toner particles formed in the toner particle dispersion go through a washing step, a solid-liquid separation step, and a drying step which are well-known, thereby obtaining dried toner particles.

In the washing step, from the viewpoint of chargeability, displacement washing with ion exchange water may be sufficiently performed.

Further, in the solid-liquid separation step, although there is no particular limitation, from the viewpoint of productivity, suction filtration, pressure filtration, and the like may be performed. In addition, in the drying step, although there is no particular limitation, from the viewpoint of the productivity, freeze drying, air stream drying, fluidized drying, vibration type fluidized drying, and the like may be performed.

Kneading Pulverization Method

Next, a kneading pulverization method will be described.

In the kneading pulverization method, materials such as the binder resin are mixed with each other, then the materials are molten-kneaded by using a heating roller, a kneader, an extruder, and the like, and the obtained molten-kneading material is coarsely pulverized, is pulverized by using a jet mill, and is classified by using a wind classifier, thereby obtaining a toner particle having a desired particle size.

More specifically, the kneading pulverization method includes a step of kneading a material (hereinafter, also referred to as a "toner forming material" in some cases) forming a toner particle containing a binder resin, and a step of pulverizing the kneaded material. If necessary, the kneading pulverization method further includes other steps such as a step of cooling the kneaded material formed in the kneading step.

The respective steps according to the kneading pulverization method will be described in detail.

Kneading Step

In a kneading step, a toner forming material containing a binder resin is kneaded.

In the kneading step, for example, it is preferable to add an aqueous medium (for example, water such as distilled water and ion exchange water, and alcohols) in a range of 0.5 parts by weight to 5 parts by weight, with respect to 100 parts by weight of toner forming material.

Examples of a kneading machine used in the kneading step include a single-screw extruder and a twin-screw extruder. Hereinafter, as an example of the kneading machine, a kneading machine including a supplying screw portion and two kneading portions will be described with reference to the drawings; however, the example of the kneading machine is not limited thereto.

FIG. 1 is a diagram illustrating a state of a screw regarding an example of a screw extruder which is used in the kneading step of a method of preparing the toner according to the exemplary embodiment.

A screw extruder 11 is configured to include a barrel 12 which is provided with a screw (not shown), an injection port 14 for injecting a toner forming material which is a raw material of toner to the barrel 12, a liquid adding port 16 for adding an aqueous medium to the toner forming material in the barrel 12, and a discharge port 18 for discharging a kneaded material obtained by kneading the toner forming material in the barrel 12.

The barrel 12 is divided into, in order from the side close to the injection port 14, a supplying screw portion SA for supplying the toner forming material injected from the injection port 14 to a kneading portion NA, the kneading portion NA for melting and kneading the toner forming material in a first kneading step, a supplying screw portion SB for supplying the toner forming material which is molten-kneaded in the kneading portion NA to a kneading portion NB, the kneading portion NB for melting and kneading the toner forming material in a second kneading step so as to form a kneaded material, and a supplying screw portion SC for supplying the formed kneaded material to the discharge port 18.

In addition, a temperature control unit (not shown) which is different for each block is provided in the barrel 12. That is, a block 12A to a block 12J may be controlled to be different temperature. Note that, FIG. 1 illustrates a state where the temperature of each of the block 12A and the block 12B is set to be t0° C., the temperature of each of the block 12C to the block 12E is set to be t1° C., and the temperature of each of the block 12F to the block 12J is set to be t2° C. For this reason, the toner forming material of the kneading portion NA is heated at t1° C., and the toner forming material of the kneading portion NB is heated at t2° C.

When the toner forming material which contains the binder resin, the coloring agent, and a release agent, if necessary, is supplied to the barrel 12 from the injection port 14, the toner forming material is transported to the kneading portion NA from the supplying screw portion SA. At this time, the temperature of the block 12C is set to be t1° C., and thus the toner forming material which is heated and changed to a molten state is supplied to the kneading portion NA. Further, the temperature of each of the block 12D and the block 12E is also set to be t1° C., and thus in the kneading portion NA, the toner forming material is molten-kneaded at a temperature of t1° C. The binder resin and the release agent are in a molten state in the kneading portion NA, and receive shearing force from the screw.

Subsequently, the toner forming material which is kneaded in the kneading portion NA is supplied to the kneading portion NB by the supplying screw portion SB.

Then, in the supplying screw portion SB, the aqueous medium is added to the toner forming material by injecting the aqueous medium to the barrel 12 from the liquid adding port 16. In addition, although FIG. 1 illustrates an example of injecting the aqueous medium in the supplying screw portion SB, the exemplary embodiment is not limited to the example, and the aqueous medium may be injected in the kneading portion NB, and the aqueous medium may be injected in both of the supplying screw portion SB and the kneading portion NB. That is, a position to which the aqueous medium is injected and the number of positions to be injected are selected if necessary.

As described above, when the aqueous medium is injected to the barrel 12 from the liquid adding port 16, the toner forming material and aqueous medium are mixed with each other in the barrel 12, the toner forming material is cooled due to latent heat of vaporization of the aqueous medium, and thus the temperature of the toner forming material is maintained.

Lastly, a kneaded material formed by being molten-kneaded by the kneading portion NB is transported to the discharge port 18 by the supplying screw portion SC, and then discharged from the discharge port 18.

In the way described above, the kneading step by using the screw extruder 11 as illustrated in FIG. 1 is performed.

Cooling Step

A cooling step is a step of cooling the kneaded material formed in the above-described kneading step, and in the cooling step, the temperature of the kneaded material at the time of completing the kneading step is desired to be cooled down to be equal to or lower than 40° C. at an average temperature lowering speed of equal to or higher than 4° C./sec. In a case where the cooling speed of the kneaded material is slow, a mixture (a mixture of a coloring agent and an internal additive such as a release agent which is internally added in the toner particle if necessary) which is finely dispersed in the binder resin in the kneading step is re-crystalized, and a dispersion diameter may be increased. On the other hand, it is preferable to rapidly cool the kneaded material at the average temperature lowering speed so as to maintain the dispersed state immediately after the kneading step. Note that, the average temperature lowering speed means an average value of the speed at which the temperature (for example, t2° C. in a case where of using the screw extruder 11 of FIG. 1) of the kneaded material at the time of completing the kneading step is cooled down to 40° C.

Specific examples of the method of cooling in the cooling step include a method of using a rolling roller which circulates cold water or brine, and a pinched type cooling belt. Note that, in a case where the cooling is performed by using the above-described method, the cooling speed is determined by a speed of the rolling roller, a flow rate of the brine, a supply amount of the kneaded material, a slab thickness during the rolling of the kneaded material. The slab thickness is preferably from 1 mm to 3 mm.

Pulverizing Step

The kneaded material which is cooled in the cooling step is pulverized in the pulverizing step so as to form a particle. In the pulverizing step, for example, a mechanical pulverizer and a jet type pulverizer are used. A pulverized material may be spheroidized by heat or mechanical impact force.

Classification Step

The particle obtained in the pulverizing step may be classified in the classification step so as to obtain a toner particle having a volume average particle diameter in a target range, if necessary. In the classification step, fine powder (a particle smaller than the target particle diameter range) and coarse powder (a particle larger than the target particle diameter range) are removed by using a centrifugal classifier, an air classifier, and the like are used from the related art.

In addition, in a case where the toner particle is prepared by using the kneading pulverization method, a method, in which only a portion of the white pigment is aggregated so as to be set as a large sized particle, the remaining portion of the white pigment is set as a small sized particle which is an isolated particle, and the large sized particle and the small sized particle are dispersed in the toner particle, is not particularly limited, and the following methods are exemplified.

Specifically, a method of performing two-stage kneading in the kneading step is exemplified. The two-stage kneading includes a first kneading step in which a portion of the entire toner forming materials is kneaded under the condition with a strong shearing force (specifically, the condition of a twin-continuous kneader having a screw structure and a high rotation speed of the screw in the kneading step), and a second kneading step in which the kneaded material in the first kneading step and the remaining toner forming materials are kneaded under the condition with a shearing force weaker than that in the first kneading step (specifically, the condition of a twin-continuous kneader having a screw structure and a low rotation speed of the screw in the kneading step).

In addition, the maximum Feret diameter of the aggregate, the particle size distribution (that is, the ratio of the small sized particle to the large sized particle) of the white pigment particle present in the toner particle, and the like are controlled by adjusting the kneading conditions in the first kneading step and the second kneading step.

As described above, the toner particles are prepared. Note that, the method of preparing the toner particles is not limited to the above-described method.

The toner according to the exemplary embodiment is prepared by adding and mixing, for example, an external additive to the obtained dry toner particles. The mixing may be performed with, for example, a V-blender, a Henschel mixer, a Lodigemixer, or the like. Furthermore, if necessary, coarse particles of the toner may be removed by using a vibration sieving machine, a wind classifier, or the like.

Electrostatic Charge Image Developer

The electrostatic charge image developer in the exemplary embodiment includes at least the toner in the exemplary embodiment.

The electrostatic charge image developer in the exemplary embodiment may be a one-component developer including only the toner in the exemplary embodiment, or may be a two-component developer in which the toner and a carrier are mixed.

The carrier is not particularly limited, and a well-known carrier may be used. Examples of the carrier include a coating carrier in which the surface of the core formed of magnetic particle is coated with the coating resin; a magnetic particle dispersion-type carrier in which the magnetic particle are dispersed and blended in the matrix resin; and a resin impregnated-type carrier in which a resin is impregnated into the porous magnetic particles.

Note that, the magnetic particle dispersion-type carrier and the resin impregnated-type carrier may be a carrier in which the forming particle of the carrier is set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include a straight silicone resin formed by containing polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and an organosiloxane bond, or the modified products thereof, a fluororesin, polyester, polycarbonate, a phenol resin, and an epoxy resin.

Note that, other additives such as the conductive particles may be contained in the coating resin and the matrix resin.

Examples of the conductive particle include metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (weight ratio) of the toner to the carrier in the two-component developer is preferably in a range of toner:carrier=1:100 to 30:100, and is further preferably in a range of 3:100 to 20:100.

Image Forming Apparatus and Image Forming Method

An image forming apparatus and an image forming method according to this exemplary embodiment will be described.

The image forming apparatus according to the exemplary embodiment is provided with an image holding member, a charging unit that charges the surface of the image holding member, an electrostatic charge image forming unit that forms an electrostatic charge image on the charged surface of the image holding member, a developing unit that accommodates an electrostatic charge image developer, and develops the electrostatic charge image formed on the surface of the image holding member as a toner image by using the electrostatic charge image developer, a transfer unit that transfers the toner image formed on the surface of the image holding member to a surface of a recording medium, and a fixing unit that fixes the toner image transferred onto the surface of the recording medium. In addition, the electrostatic charge image developer according to the exemplary embodiment is used as the electrostatic charge image developer.

In the image forming apparatus according to the exemplary embodiment, an image forming method (the image forming method according to the exemplary embodiment) including a step of charging a surface of an image holding member, a step of forming an electrostatic charge image on the charged surface of the image holding member, a step of developing an electrostatic charge image formed on the surface of the image holding member as a toner image with the electrostatic charge image developer according to the exemplary embodiment, a step of transferring the toner image formed on the surface of the image holding member to a surface of a recording medium, and a step of fixing the toner image transferred to the surface of the recording medium is performed.

As the image forming apparatus according to the exemplary embodiment, well-known image forming apparatuses including a direct-transfer type apparatus that directly transfers the toner image formed on the surface of the image holding member to the recording medium; an intermediate transfer type apparatus that primarily transfers the toner image formed on the surface of the image holding member to a surface of an intermediate transfer member, and secondarily transfers the toner image transferred to the intermediate transfer member to the surface of the recording medium; an apparatus including a cleaning unit that cleans the surface of the image holding member before being charged and after transferring the toner image; and an apparatus including an erasing unit that erases charges by irradiating the surface of the image holding member with erasing light before being charged and after transferring the toner image, are adopted.

In a case where the intermediate transfer type apparatus is used, the transfer unit is configured to include an intermediate transfer member which the toner image is transferred on the surface thereof, a primary transfer unit that primarily transfers the toner image formed on the surface of the image holding member to the surface of the intermediate transfer member, and a secondary transfer unit the toner image formed on the surface of the intermediate transfer member is secondarily transferred to the surface of the recording medium.

In the image forming apparatus according to the exemplary embodiment, for example, a unit including the developing unit may be a cartridge structure (process cartridge) detachable from the image forming apparatus. As a process cartridge, for example, a process cartridge including the developing unit accommodating the electrostatic charge image developer in the exemplary embodiment is preferably used.

The image forming apparatus according to the exemplary embodiment is not particularly limited as long as it uses the toner according to the exemplary embodiment. For example, the image forming apparatus in which the toner according to the exemplary embodiment is used as white toner (white toner), and further uses at least one selected from yellow toner, magenta toner, cyan toner, and black toner is exemplified.

Hereinafter, an example of the image forming apparatus of the exemplary embodiment will be described; however, the invention is not limited thereto. Note that, in the drawing, major portions will be described, and others will not be described.

Figure 2:
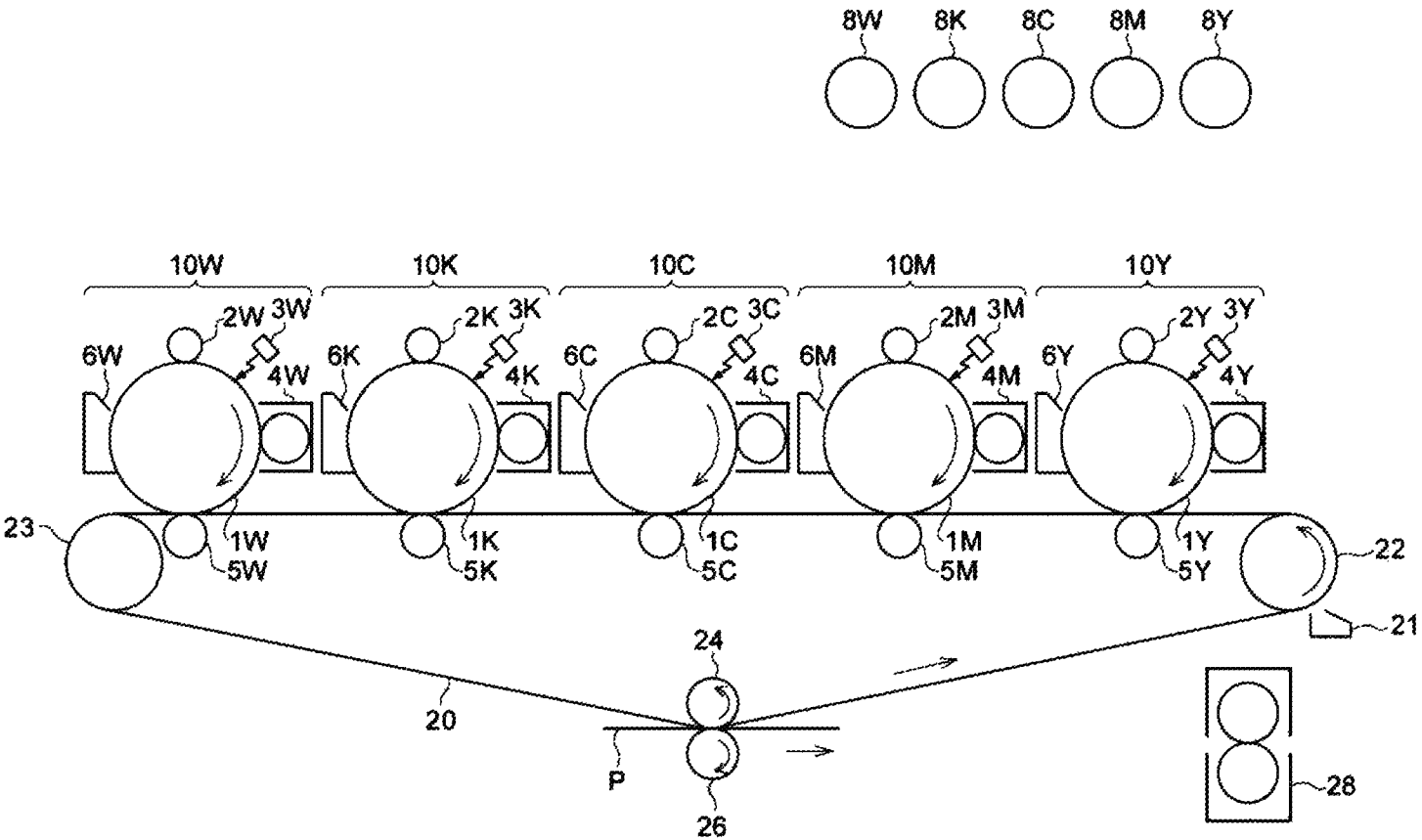
FIG. 2 is a configuration diagram illustrating an example of an image forming apparatus according to the exemplary embodiment.

FIG. 2 is a configuration diagram illustrating the image forming apparatus according to the exemplary embodiment, and is a diagram illustrating an image forming apparatus of a 5-tandem tandem type and an intermediate transfer type.

The image forming apparatus as illustrated in FIG. 2 is provided with electrophotographic type first to fifth image forming units 10Y, 10M, 10C, 10K, and 10W (image forming unit) that output an image for each color of yellow (Y), magenta (M), cyan (C), black (K), and white (W) based on color separated image data. These image forming units 10Y, 10M, 10C, 10K, and 10W (hereinafter, simply referred to as a "unit" in some cases) are arranged apart from each other by a predetermined distance in the horizontal direction. Note that, the units 10Y, 10M, 10C, 10K, and 10W may be the process cartridge which is detachable with respect to the image forming apparatus.

As an intermediate transfer member, an intermediate transfer belt 20 passing through the respective units is extended upward in the drawing of the respective units 10Y, 10M, 10C, 10K, and 10W. The intermediate transfer belt 20 is provided to be wound around a driving roller 22 and a supporting roller 23 contacting the inner surface of an intermediate transfer belt 20 which are disposed apart from each other in the horizontal direction in the drawing, and travels to the direction from the first unit 10Y to the fourth unit 10K. In addition, a force is applied to the supporting roller 23 in the direction apart from the driving roller 22 by a spring or the like (not shown), and thus a tension is applied to the intermediate transfer belt 20 which is wound around the both. Further, an intermediate transfer member cleaning device 21 is provided on the side surface of the image holding member of the intermediate transfer belt 20 so as to face the driving roller 22.

In addition, four colors toner of yellow, magenta, cyan, and black stored in toner cartridges 8Y, 8M, 8C, and 8K are correspondingly supplied to each of developing devices (an example of the developing unit) 4Y, 4M, 4C, and 4K of the each of the units 10Y, 10M, 10C, and 10K.

The first to fifth units 10Y, 10M, 10C, 10K, and 10W have the same configuration, operation, and action as each other, and thus the first unit 10Y for forming a yellow image disposed on the upstream side of the travel direction of the intermediate transfer belt will be representatively described.

The first unit 10Y includes a photoreceptor 1Y serving as an image holding member. In the vicinity of the photoreceptor 1Y, a charging roller (an example of the charging unit) 2Y which charges the surface of the photoreceptor 1Y with a predetermined potential, an exposure device (an example of the electrostatic charge image forming unit) 3Y which exposes the charged surface by using a laser beam based on color separated image signal so as to form an electrostatic charge image, a developing device (an example of the developing unit) 4Y which supplies the toner to the electrostatic charge image and develops the electrostatic charge image, a primary transfer roller 5Y (an example of the primary transfer unit) which transfers the developed toner image onto the intermediate transfer belt 20, and a photoreceptor cleaning device (an example of the cleaning unit) 6Y which removes the residual toners remaining on the surface of the photoreceptor 1Y after primary transfer are sequentially disposed.

The primary transfer roller 5Y is disposed inside the intermediate transfer belt 20, and is provided at a position facing the photoreceptor 1Y. A bias power supply (not shown) which applies primary transfer bias is connected to each of the primary transfer rollers 5Y, 5M, 5C, 5K, and 5W of each of the units. The bias power supply changes a value of the transfer bias which is applied to each of the primary transfer rollers by control of a controller (not shown).

Hereinafter, an operation of forming a yellow image in the first unit 10Y will be described.

First, before starting the operation, the surface of the photoreceptor 1Y is charged with the potential in a range of −600 V to −800 V by the charging roller 2Y.

The photoreceptor 1Y is formed by stacking the photosensitive layers on the conductive substrate (for example, volume resistivity of equal to or less than $1\times10^{-6}$ Ωcm at 20° C.). The photosensitive layer typically has high resistance (the resistance of the typical resin), but when being irradiated with the laser beam, it has the property of changing the resistivity of a portion which is irradiated with the laser beam. In this regard, in accordance with image data for yellow transmitted from the control unit (not shown), the charged surface of the photoreceptor 1Y is irradiated with the laser beam from the exposure device 3Y. With this, the electrostatic charge image of a yellow image pattern is formed on the surface of the photoreceptor 1Y.

The electrostatic charge image is an image formed on the surface of the photoreceptor 1Y by charging and a so-called negative latent image formed such that resistivity of a portion of the photosensitive layer to be irradiated with the laser beam from the exposure device 3Y is decreased, and the charges on the charged surface of the photoreceptor 1Y flow, while charges of a portion which is not irradiated with the laser beam remain.

The electrostatic charge image formed on the photoreceptor 1Y is rotated to the predetermined developing position in accordance with the traveling of the photoreceptor 1Y. Further, the electrostatic charge image on the photoreceptor 1Y is visualized (developed) in the developing position as a toner image by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is charged on the photoreceptor 1Y, and is thus held on the developer roller (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 ρA in the first unit 10Y by the controller (not shown).

On the other hand, the toner remaining on the photoreceptor 1Y is removed and collected by a photoreceptor cleaning device 6Y.

The primary transfer biases that are applied to the primary transfer rollers 5M, 5C, 5K, and 5W of the second unit 10M and the subsequent units are also controlled in the same manner as in the case of the first unit.

In this manner, the intermediate transfer belt 20 onto which the yellow toner image is transferred in the first unit 10Y is sequentially transported through the second to fifth units 10M, 10C, 10K, and 10W and the toner images of respective colors are multiply-transferred in a superimposed manner.

The intermediate transfer belt 20 onto which the five color toner images have been multiply-transferred through the first to fifth units reaches a secondary transfer part that is composed of the intermediate transfer belt 20, the facing roller 24 contacting the inner surface of the intermediate transfer belt, and a secondary transfer roller (an example of the secondary transfer unit) 26 disposed on the image holding surface side of the intermediate transfer belt 20. Meanwhile, a recording sheet (an example of the recording medium) P is supplied to a gap between the secondary transfer roller 26 and the intermediate transfer belt 20, that contact with each other, via a supply mechanism at a predetermined timing, and a secondary transfer bias is applied to the facing roller 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detecting unit (not shown) that detects the resistance of the secondary transfer part, and is voltage-controlled.

Thereafter, the recording sheet P is fed to a nip portion of a pair of fixing roller in a fixing device (an example of the fixing unit) 28 so that the toner image is fixed to the recording sheet P, and thereby a fixed image is formed.

Examples of the recording sheet P, to which the toner image is transferred, include plain paper that is used in electrophotographic copying machine, printers, and the like, and as a recording medium, an OHP sheet is also exemplified other than the recording sheet P.

In order to further improve the smoothness of the image surface after fixing, the surface of the recording sheet P is also preferably smooth. For example, coated paper obtained by coating the surface of plain paper with resin or the like, art paper for printing, or the like is preferably used.

The recording sheet P on which the fixing of the color image is completed is transported toward a discharge part, and a series of the color image forming operations end.

Process Cartridge and Toner Cartridge

A process cartridge according to the exemplary embodiment will be described.

The process cartridge according to the exemplary embodiment is provided with a developing unit that accommodates the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and as necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 3:
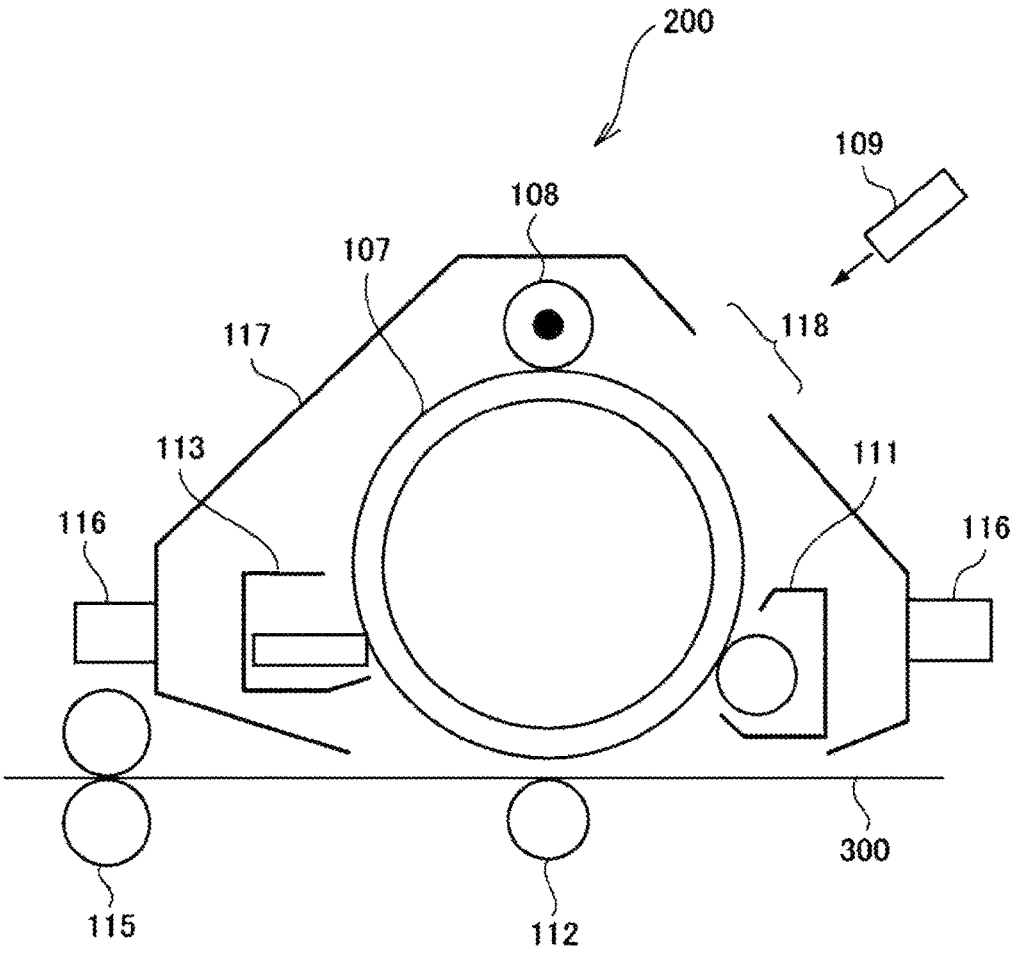
FIG. 3 is a configuration diagram illustrating an example of a process cartridge according to the exemplary embodiment.

FIG. 3 is a configuration diagram illustrating the process cartridge according to this exemplary embodiment.

The process cartridge 200 illustrated in FIG. 3 is configured such that a photoreceptor 107 (an example of the image holding member), a charging roller 108 (an example of the charging unit) which is provided in the vicinity of the photoreceptor 107, a developing device 111 (an example of the developing unit), and a photoreceptor cleaning device 113 (an example of the cleaning unit) are integrally formed in combination, and are held by a housing 117 which is provided with an attached rail 116 and an opening portion 118 for exposing light.

Note that, in FIG. 3, reference numeral 109 is denoted as an exposure device (an example of the electrostatic charge image forming unit), reference numeral 112 is denoted as a transfer device (an example of the transfer unit), reference numeral 115 is denoted as a fixing device (an example of the fixing unit), and reference numeral 300 is denoted as a recording sheet (an example of the recording medium).

Next, the toner cartridge of the exemplary embodiment will be described.

The toner cartridge according to the exemplary embodiment accommodates the toner according to the exemplary embodiment and is detachable from an image forming apparatus. The toner cartridge contains a toner for replenishment for being supplied to the developing unit provided in the image forming apparatus.

The image forming apparatus shown in FIG. 2 has such a configuration that the toner cartridges 8Y, 8M, 8C, 8K, and 8W are detachable therefrom, and the developing devices 4Y, 4M, 4C, 4K and 4W are connected to the toner cartridges corresponding to the respective developing devices (colors) via toner supply tubes (not shown), respectively. In addition, when the toner accommodated in the toner cartridge runs low, the toner cartridge is replaced. An example of the toner cartridge of the exemplary embodiment is the toner cartridge 8W.

EXAMPLES

Hereinafter, the exemplary embodiment will be described in detail using Examples and Comparative examples, but is not limited to the following examples. In the following description, unless specifically noted, "parts" and "%" are based on the weight.

Preparation of Toner Particle (1)

Preparation of White Pigment Particle (1)

0.15 mol of glycerin is added to 100 mL of a 1 mol/L titanium tetrachloride aqueous solution, and heated at 90° C. for four hours so as to form a white particle, and then resultant is filtrated. The obtained white particle is dispersed in 100 mL of ion exchange water, 0.4 mol of hydrochloric acid is added thereto, and the resultant is heated again at 90° C. for three hours. The pH of the resultant is adjusted to be 7 with 0.1 N of sodium hydroxide, filtrated, washed by water, and then dried (105° C. for 12 hours), thereby obtaining a white pigment particle (1) which is a titanium dioxide particle. The number average of the maximum Feret diameter in the primary particle of the obtained white pigment particles is 250 nm and the average circularity is 0.90.

Preparation of White Pigment Particle Dispersion (1)

White pigment particle (1): 60 parts

Anionic surfactant (NEOGEN RK prepared by Daiichi Kogyo Seiyaku Co., Ltd.): 5 parts Ion exchange water: 240 parts The above-described materials are mixed with each other, and the mixture is dispersed for 30 minutes by using a homogenizer (ULTRA-TURRAX T50, manufactured by IKA Ltd). The ion exchange water is added to the mixture such that the solid content in the dispersion is 50% by weight, and thereby a white pigment particle dispersion (1) in which the titanium dioxide particle is dispersed is obtained.

Synthesizing of Polyester Resin (1)

Terephthalic acid: 30 parts by mol

Fumaric acid: 70 parts by mol

Bisphenol A ethylene oxide adduct: 5 parts by mol

Bisphenol A propylene oxide adduct: 95 parts by mol

The above-described materials are put into a flask which has five liters of content, and equipped with a stirrer, a nitrogen inlet pipe, a temperature sensor, and a rectification column, the temperature of the flask is raised up to 220° C. over one hour, and then 1 part of titanium tetraethoxide is added to 100 parts of the above materials. While distilling off water to be generated, the temperature was raised up to 230° C. over 0.5 hours, dehydration condensation reaction is continued for one hour at the temperature, and then a reaction result is cooled. In this way, a polyester resin (1) having a weight average molecular weight of 18,000, an acid value of 15 mgKOH/g, and a glass transition temperature of 60° C. is synthesized.

Preparation of Particle Dispersion (1)

40 parts of ethyl acetate and 25 parts of 2-butanol are put into a container provided with a temperature control unit and a nitrogen replacement unit so as to prepare a mixed solvent, then 100 parts of polyester resin (1) is slowly put into the container and dissolved, and 10% by weight of ammonia aqueous solution (equivalent to three times the molar ratio with respect to the acid value of the resin) is put into the container and stirred for 30 minutes.

Subsequently, the interior of the container is replaced with dry nitrogen, 400 parts of ion exchange water is added dropwise at a rate of 2 parts per minute while maintaining the temperature at 40° C. and stirring the mixed solution so as to perform emulsification. After completing the dropwise addition, the emulsion is returned to room temperature (from 20° C. to 25° C.) and bubbling with dry nitrogen is performed for 48 hours with stirring, and thus ethyl acetate and 2-butanol are reduced to equal to or less than 1,000 ppm, thereby obtaining a resin particle dispersion in which a resin particle having a volume average particle diameter of 200 nm is dispersed. The ion exchange water is added to the resin particle dispersion so as to adjust the solid content to be 20% by weight, and thereby a resin particle dispersion (1) is obtained.

Preparation of Release Agent Particle Dispersion (1)

Paraffin wax (HNP-9, prepared by Nippon Seiro, Co., Ltd.): 100 parts

Anionic surfactant (NEOGEN RK, prepared by Dai-ichi Kogyo Seiyaku Co., Ltd.): 1 part Ion exchange water: 350 parts The above-described materials are mixed with each other, the mixture is heated at 100° C., is dispersed by using a homogenizer (ULTRA-TURRAX T50, manufactured by IKA Ltd.), and then is subjected to a dispersing treatment by using Manton-Gaulin high pressure homogenizer (manufactured by Manton Gaulin Mfg Company Inc), thereby obtaining a release agent particle dispersion (1) (solid content 20% by weight) in which a release agent particle having a volume average particle diameter of 200 nm is dispersed.

Preparation of Polyacrylamide Aqueous Solution (1)

Polyacrylamide particle (prepared by Wako Pure Chemical Industries, Ltd., weight average molecular weight: 4,000,000): 14 parts Ion exchange water: 86 parts The above-described components are mixed with each other, and the mixture is dispersed at an oscillation frequency of 28 kHz for 60 minutes by using an ultrasonic cleaning machine (W-113, manufactured by HONDA ELECTRONICS Co., LTD), thereby obtaining a polyacrylamide aqueous solution (1).

Preparation of Toner Particle (1)

Resin particle dispersion (1): 350 parts

White pigment particle dispersion (1): 100 parts

Release agent particle dispersion (1): 50 parts

Anionic surfactant (TaycaPower prepared by TAYCA CORPORATION): 2 parts

20% of the entire above-described materials and 0.01 parts of polyacrylamide aqueous solution (1) are put into a round stainless steel flask, 0.1 N of nitric acid is added to the flask, the pH is adjusted to be 6.0, and then the mixture is stirred for 30 minutes.

After that, the remainder of the materials (that is, 80% of the entire materials) and 30 parts by weight of nitric acid aqueous solution having 10 weight % of concentration of polyaluminum chloride (prepared by Asada Chemical INDUSTRY Co., Ltd., Paho2S) are added to the resultant. Subsequently, the resultant is dispersed at 30° C. by using a homogenizer (ULTRA-TURRAX T50, manufactured by IKA Ltd.), and then is heated at 45° C. and kept for 30 minutes in an oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (1) having the volume average particle diameter of 7.5 μm.

Preparation of Toner Particle (2)

Resin particle dispersion (1): 350 parts

White pigment particle dispersion (1): 100 parts

Release agent particle dispersion (1): 50 parts

Anionic surfactant (prepared by TAYCA CORPORATION, TaycaPower): 2 parts

7% of the entire above-described materials and 0.01 parts of polyacrylamide aqueous solution (1) are put into a round stainless steel flask, 0.1 N of nitric acid is added to the flask, the pH is adjusted to be 6.0, and then the mixture is stirred for 30 minutes.

After that, the remainder of the materials (that is, 93% of the entire materials) and 30 parts by weight of nitric acid aqueous solution having 10 weight % of concentration of polyaluminum chloride (prepared by Asada Chemical INDUSTRY Co., Ltd., Paho2S) are added to the resultant. Subsequently, the resultant is dispersed at 30° C. by using a homogenizer (ULTRA-TURRAX T50, manufactured by IKA Ltd.), and then is heated at 45° C. and kept for 30 minutes in an oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (2) having the volume average particle diameter of 7.5 μm.

Preparation of Toner Particle (3)

Resin particle dispersion (1): 350 parts

White pigment particle dispersion (1): 100 parts

Release agent particle dispersion (1): 50 parts

Anionic surfactant (prepared by TAYCA CORPORATION, TaycaPower): 2 parts

38% of the entire above-described materials and 0.01 parts of polyacrylamide aqueous solution (1) are put into a round stainless steel flask, 0.1 N of nitric acid is added to the flask, the pH is adjusted to be 6.0, and then the mixture is stirred for 30 minutes.

After that, the remainder of the materials (that is, 62% of the entire materials) and 30 parts by weight of nitric acid aqueous solution having 10 weight % of concentration of polyaluminum chloride (prepared by Asada Chemical INDUSTRY Co., Ltd., Paho2S) are added to the resultant. Subsequently, the resultant is dispersed at 30° C. by using a homogenizer (ULTRA-TURRAX T50, manufactured by IKA Ltd.), and then is heated at 45° C. and kept for 30 minutes in an oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (3) having the volume average particle diameter of 7.5 μm.

Preparation of Toner Particle (4)

Resin particle dispersion (1): 350 parts

White pigment particle dispersion (1): 100 parts

Release agent particle dispersion (1): 50 parts

Anionic surfactant (prepared by TAYCA CORPORATION, TaycaPower): 2 parts

50% of the entire above-described materials and 0.01 parts of polyacrylamide aqueous solution (1) are put into a round stainless steel flask, 0.1 N of nitric acid is added to the flask, the pH is adjusted to be 6.0, and then the mixture is stirred for 30 minutes.

After that, the remainder of the materials (that is, 50% of the entire materials) and 30 parts by weight of nitric acid aqueous solution having 10 weight % of concentration of polyaluminum chloride (prepared by Asada Chemical INDUSTRY Co., Ltd., Paho2S) are added to the resultant. Subsequently, the resultant is dispersed at 30° C. by using a homogenizer (ULTRA-TURRAX T50, manufactured by IKA Ltd.), and then is heated at 45° C. and kept for 30 minutes in an oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (4) having the volume average particle diameter of 7.5 μm.

Preparation of Toner Particle (5)

Preparation of White Pigment Particle (2)

0.15 mol of glycerin is added to 100 mL of a 1 mol/L titanium tetrachloride aqueous solution, and heated at 95° C. for seven hours so as to form a white particle, and then resultant is filtrated. The obtained white particle is dispersed in 100 mL of ion exchange water, 0.4 mol of hydrochloric acid is added thereto, and the resultant is heated again at 95° C. for four hours. the pH of the resultant is adjusted to be 7 with 0.1 N of sodium hydroxide, filtrated, washed by water, and then dried (105° C. for 12 hours), thereby obtaining a white pigment particle (2) which is a titanium dioxide particle. The number average of the maximum Feret diameter in the primary particle of the obtained white pigment particles is 750 nm and the average circularity is 0.90.

Preparation of White Pigment Particle Dispersion (2)

White pigment particle (2): 60 parts

Anionic surfactant (NEOGEN RK prepared by Daiichi Kogyo Seiyaku Co., Ltd.): 5 parts Ion exchange water: 240 parts The above-described materials are mixed with each other, and the mixture is dispersed for 30 minutes by using a homogenizer (ULTRA-TURRAX T50, manufactured by IKA Ltd). The ion exchange water is added to the mixture such that the solid content in the dispersion is 50% by weight, and thereby a white pigment particle dispersion (2) in which the titanium dioxide particle is dispersed is obtained.

Preparation of Toner Particle (5)

Resin particle dispersion (1): 350 parts

White pigment particle dispersion (1): 80 parts

White pigment particle dispersion (2): 20 parts

Release agent particle dispersion (1): 50 parts

Anionic surfactant (prepared by TAYCA CORPORATION, TaycaPower): 2 parts 30 parts by weight of nitric acid aqueous solution having 10 weight % of concentration of polyaluminum chloride (prepared by Asada Chemical INDUSTRY Co., Ltd., Paho2S) is added to the entire above-described materials. Then, the mixture is dispersed at 30° C. by using a homogenizer (ULTRA-TURRAX T50, manufactured by IKA Ltd.), and then is heated at 45° C. and kept for 30 minutes in the oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (5) having the volume average particle diameter of 7.5 μm.

Preparation of Toner Particle (6)

Resin particle dispersion (1): 200 parts

White pigment particle dispersion (1): 250 parts

Release agent particle dispersion (1): 50 parts

Anionic surfactant (prepared by TAYCA CORPORATION, TaycaPower): 2 parts

20% of the entire above-described materials and 0.01 parts of polyacrylamide aqueous solution (1) are put into a round stainless steel flask, 0.1 N of nitric acid is added to the flask, the pH is adjusted to be 6.0, and then the mixture is stirred for 30 minutes.

After that, the remainder of the materials (that is, 80% of the entire materials) and 30 parts by weight of nitric acid aqueous solution having 10 weight % of concentration of polyaluminum chloride (prepared by Asada Chemical INDUSTRY Co., Ltd., Paho2S) are added to the resultant. Subsequently, the resultant is dispersed at 30° C. by using a homogenizer (ULTRA-TURRAX T50, manufactured by IKA Ltd.), and then is heated at 45° C. and kept for 30 minutes in an oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (6) having the volume average particle diameter of 7.5 μm.

Preparation of Toner Particle (7)

Resin particle dispersion (1): 400 parts

White pigment particle dispersion (1): 50 parts

Release agent particle dispersion (1): 50 parts

Anionic surfactant (prepared by TAYCA CORPORATION, TaycaPower): 2 parts

20% of the entire above-described materials and 0.01 parts of polyacrylamide aqueous solution (1) are put into a round stainless steel flask, 0.1 N of nitric acid is added to the flask, the pH is adjusted to be 6.0, and then the mixture is stirred for 30 minutes.

After that, the remainder of the materials (that is, 80% of the entire materials) and 30 parts by weight of nitric acid aqueous solution having 10 weight % of concentration of polyaluminum chloride (prepared by Asada Chemical INDUSTRY Co., Ltd., Paho2S) are added to the resultant. Subsequently, the resultant is dispersed at 30° C. by using a homogenizer (ULTRA-TURRAX T50, manufactured by IKA Ltd.), and then is heated at 45° C. and kept for 30 minutes in an oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (7) having the volume average particle diameter of 7.5 μm.

Preparation of Toner Particle (8)

Preparation of White Pigment Particle (3)

0.15 mol of glycerin is added to 100 mL of a 1 mol/L titanium tetrachloride aqueous solution, and heated at 90° C. for four hours so as to form a white particle, and then resultant is filtrated. The obtained white particle is dispersed in 100 mL of ion exchange water, 0.8 mol of hydrochloric acid is added thereto, and the resultant is heated again at 90° C. for seven hours. the pH of the resultant is adjusted to be 7 with 0.1 N of sodium hydroxide, filtrated, washed by water, and then dried (105° C. for 12 hours), thereby obtaining a white pigment particle (3) which is a titanium dioxide particle. The number average of the maximum Feret diameter in the primary particle of the obtained white pigment particles is 250 nm and the average circularity is 0.95.

Preparation of White Pigment Particle Dispersion (3)

White pigment particle (3): 60 parts

Anionic surfactant (NEOGEN RK prepared by Daiichi Kogyo Seiyaku Co., Ltd.): 5 parts Ion exchange water: 240 parts The above-described materials are mixed with each other, and the mixture is dispersed for 30 minutes by using a homogenizer (ULTRA-TURRAX T50, manufactured by IKA Ltd). The ion exchange water is added to the mixture such that the solid content in the dispersion is 50% by weight, and thereby a white pigment particle dispersion (3) in which the titanium dioxide particle is dispersed is obtained.

Preparation of Toner Particle (8)

Resin particle dispersion (1): 350 parts

White pigment particle dispersion (3): 100 parts

Release agent particle dispersion (1): 50 parts

Anionic surfactant (prepared by TAYCA CORPORATION, TaycaPower): 2 parts

20% of the entire above-described materials and 0.01 parts of polyacrylamide aqueous solution (1) are put into a round stainless steel flask, 0.1 N of nitiric acid is added to the flask, the pH is adjusted to be 6.0, and then the mixture is stirred for 30 minutes.

After that, the remainder of the materials (that is, 80% of the entire materials) and 30 parts by weight of nitric acid aqueous solution having 10 weight % of concentration of polyaluminum chloride (prepared by Asada Chemical INDUSTRY Co., Ltd., Paho2S) are added to the resultant. Subsequently, the resultant is dispersed at 30° C. by using a homogenizer (ULTRA-TURRAX T50, manufactured by IKA Ltd.), and then is heated at 45° C. and kept for 30 minutes in an oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (8) having the volume average particle diameter of 7.5 μm.

Preparation of Toner Particle (9)

Preparation of White Pigment Particle (4)

0.15 mol of glycerin is added to 100 mL of a 1 mol/L titanium tetrachloride aqueous solution, and heated at 95° C. for five hours so as to form a white particle, and then resultant is filtrated. The obtained white particle is dispersed in 100 mL of ion exchange water, 0.1 mol of hydrochloric acid is added thereto, and the resultant is heated again at 85° C. for two hours. the pH of the resultant is adjusted to be 7 with 0.1 N of sodium hydroxide, filtrated, washed by water, and then dried (105° C. for 12 hours), thereby obtaining a white pigment particle (4) which is a titanium dioxide particle. The number average of the maximum Feret diameter in the primary particle of the obtained white pigment particles is 250 nm and the average circularity is 0.85.

Preparation of White Pigment Particle Dispersion (4)

White pigment particle (4): 60 parts

Anionic surfactant (NEOGEN RK prepared by Daiichi Kogyo Seiyaku Co., Ltd.): 5 parts Ion exchange water: 240 parts The above-described materials are mixed with each other, and the mixture is dispersed for 30 minutes by using a homogenizer (ULTRA-TURRAX T50, manufactured by IKA Ltd). The ion exchange water is added to the mixture such that the solid content in the dispersion is 50% by weight, and thereby a white pigment particle dispersion (4) in which the titanium dioxide particle is dispersed is obtained.

Preparation of Toner Particle (9)

Resin particle dispersion (1): 350 parts

White pigment particle dispersion (4): 100 parts

Release agent particle dispersion (1): 50 parts

Anionic surfactant (prepared by TAYCA CORPORATION, TaycaPower): 2 parts

20% of the entire above-described materials and 0.01 parts of polyacrylamide aqueous solution (1) are put into a round stainless steel flask, 0.1 N of nitric acid is added to the flask, the pH is adjusted to be 6.0, and then the mixture is stirred for 30 minutes.

After that, the remainder of the materials (that is, 80% of the entire materials) and 30 parts by weight of nitric acid aqueous solution having 10 weight % of concentration of polyaluminum chloride (prepared by Asada Chemical INDUSTRY Co., Ltd., Paho2S) are added to the resultant. Subsequently, the resultant is dispersed at 30° C. by using a homogenizer (ULTRA-TURRAX T50, manufactured by IKA Ltd.), and then is heated at 45° C. and kept for 30 minutes in an oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (8) having the volume average particle diameter of 7.5 μm.

Preparation of Toner Particle (10)

Polyester resin (1): 87 parts

Paraffin wax (HNP-9, manufactured by Nippon Seiro, Co., Ltd.): 5 parts

White pigment particle (1): 7 parts

Charge control agent (BONTRON P-51 prepared by ORIENT CHEMICAL INDUSTRIES CO., LTD.): 1 part The above-described components are pre-mixed by using 75 L of Henschel mixer, a first kneading step is performed under the following conditions with respect to 70% of the entire materials by using a twin-continuous kneader (EXTRUDER, manufactured by Kurimoto, Ltd.) having a screw structure, and then a second kneading step is performed under the following conditions with respect to a kneaded material obtained in the first kneading step and the remainder of the above-described material (that is, 30% of the entire materials), thereby obtaining a kneaded material. Specifically, the first kneading step is performed under the conditions of a kneading temperature: 180° C., a rotation speed: 300 rpm, and a kneading speed: 100 kg/h, and the second kneading step is performed under the conditions of a kneading temperature: 120° C., a rotation speed: 150 rpm, and the kneading speed: 300 kg/h.

The obtained kneaded material is pulverized by using 400AFG-CR pulverizer (manufactured by Hosokawa Micron Corporation), and then fine powers and coarse powders are removed by using an air elbow jet classifier (manufactured by MATSUBO Corporation), thereby obtaining a toner particle (10).

Preparation of Toner Particle (11)

Polyester resin (1): 87 parts

Paraffin wax (HNP-9, manufactured by Nippon Seiro, Co., Ltd.): 5 parts

White pigment particle (1): 80 parts

White pigment particle (2): 20 parts

Charge control agent (BONTRON P-51 prepared by ORIENT CHEMICAL INDUSTRIES CO., LTD.): 1 part The above-described components are pre-mixed by using 75 L of Henschel mixer, and then the kneading is performed under the following conditions by using a twin-continuous kneader (EXTRUDER, manufactured by Kurimoto, Ltd.) having a screw structure, thereby obtaining a kneaded material. Specifically, the kneading is performed under the conditions of a kneading temperature: 180° C., a rotation speed: 300 rpm, and a kneading speed: 100 kg/h.

The obtained kneaded material is pulverized by using 400AFG-CR pulverizer (manufactured by Hosokawa Micron Corporation), and then fine powders and coarse powders are removed by using an air elbow jet classifier (manufactured by MATSUBO Corporation), thereby obtaining a toner particle (11).

Preparation of Toner Particle (12)

Synthesizing of Unmodified Polyester Resin (2)

Terephthalic acid: 1243 parts

Bisphenol A ethylene oxide adduct: 1830 parts

Bisphenol A propylene oxide adduct: 840 parts

After the above-described components are heated and mixed at 180° C., 3 parts of dibutyltin oxide is added to the mixture, and water is distilled off while being heated at 220° C., thereby obtaining a polyester resin. 1500 parts of cyclohexanone is added to the obtained polyester so as to dissolve the polyester resin, and 250 parts of acetic anhydride is added to the obtained cyclohexanone solution, and the solution is heated at 130° C. Further, the obtained solution is heated under reduced pressure to remove the solvent and unreacted acid, thereby obtaining an unmodified polyester resin (2). The glass transition temperature of the obtained unmodified polyester resin (2) is 60° C.

Preparation of Polyester Prepolymer (2)

Terephthalic acid: 1243 parts

Bisphenol A ethylene oxide adduct: 1830 parts

Bisphenol A propylene oxide adduct: 840 parts

After the above-described components are heated and mixed at 180° C., 3 parts of dibutyltin oxide is added to the mixture, and water is distilled off while being heated at 220° C., thereby obtaining a polyester prepolymer. The obtained 350 parts of polyester prepolymer, 50 parts of tolylene diisocyanate, and 450 parts of ethyl acetate are put into a container, and the mixture is heated at 130° C. for three hours, thereby obtaining a polyester prepolymer having an isocyanate group (2) (hereinafter, referred as "isocyanate modified polyester prepolymer (2)").

Preparation of Ketimine Compound (2)

50 parts of methyl ethyl ketone and 150 parts of hexamethylenediamine are put into a container, and the mixture is stirred at 60° C. so as to obtain a ketimine compound (2).

Preparation of Release Agent Particle Dispersion (2)

Paraffin wax (melting temperature 89° C.): 30 parts

Ethyl acetate: 270 parts

The above-described components are wet-pulverized by using a microbead-type dispersing machine (DCP mill) in a state of being cooled at 10° C. so as to obtain a release agent particle dispersion (2).

Preparation of Oil Phase Liquid (2)

Unmodified polyester resin (2): 136 parts

White pigment particle dispersion (1): 80 parts

White pigment particle dispersion (2): 20 parts

Ethyl acetate: 56 parts

After the above-described components are stirred and mixed, 75 parts of release agent particle dispersion (2) is added to the obtained mixture, and the mixture is stirred so as to obtain an oil phase liquid (2).

Preparation of Styrene Acrylic Resin Particle Dispersion (2)

Styrene: 370 parts n-butyl acrylate: 30 parts

Acrylic acid: 4 parts

Dodecanethiol: 24 parts

Carbon tetrabromide: 4 parts

The above-described components are mixed with each other, a dissolved mixture is dispersed and emulsified in an aqueous solution in which 6 parts of nonionic surfactant (NONIPOLE 400 prepared by Sanyo Chemical Industries, Ltd.) and 10 parts of anionic surfactant (NEOGEN SC prepared by Daiichi Kogyo Seiyaku Co., Ltd.) are dissolved in 560 parts of ion exchange water, in a flask. After that, the solution is mixed for 10 minutes, an aqueous solution in which 4 parts of ammonium persulfate is dissolved in 50 parts of ion exchange water is added to the solution, the nitrogen substitution is performed, then the flask is heated in the oil bath until the temperature of the content reaches 70° C. while stirring the inside of the flask, and emulsion polymerization is continued as it is for 5 hours. In this way, a styrene acrylic resin particle dispersion (2) (resin particle density: 40% by weight) is obtained by dispersing a resin particle having an average particle size of 180 nm and the weight average molecular weight (Mw) of 15,500. Note that, the glass transition temperature of the styrene acrylic resin particle is 59° C.

Preparation of Aqueous Phase Liquid (2)

Styrene acrylic resin particle dispersion (2): 60 parts

2% by weight of aqueous solution of CELOGEN BS-H (prepared by Daiichi Kogyo Seiyaku Co., Ltd.): 200 parts Ion exchange water: 200 parts The above-described components are stirred and mixed with each other so as to obtain an aqueous phase liquid (2).

Preparation of Toner Particle (12)

Oil phase liquid (2): 300 parts

Isocyanate modified polyester prepolymer (2): 25 parts

Ketimine compound (2): 0.5 parts

After an oil phase liquid (2P) is obtained by putting the above-described components into a container and stirring the components for two minutes by using a homogenizer (ULTRA-TURRAX T50, manufactured by IKA Ltd.), 1,000 parts of aqueous phase liquid (2) is added to the container, and the mixture is stirred for 20 minutes by using the homogenizer. Subsequently, the mixed solution is stirred with a propeller stirrer at room temperature (25° C.) and normal pressure (1 atm) for 48 hours to react the isocyanate modified polyester prepolymer (2) with the ketimine compound (2) so as to prepare a urea modified polyester resin, and remove an organic solvent, thereby forming a particulate. Then, the particulate is washed with water, dried, and classified so as to obtain a toner particle (11).

The volume average particle diameter of the obtained toner particle (12) which is measured by the method described above is 6.1 μm.

Preparation of Toner Particle (C1)

Resin particle dispersion (1): 350 parts

White pigment particle dispersion (1): 100 parts

Release agent particle dispersion (1): 50 parts

Anionic surfactant (prepared by TAYCA CORPORATION, TaycaPower): 2 parts 30 parts by weight of nitric acid aqueous solution having 10 weight % of concentration of polyaluminum chloride (prepared by Asada Chemical INDUSTRY Co., Ltd., Paho2S) is added to the entire above-described materials. Then, the mixture is dispersed at 30° C. by using a homogenizer (ULTRA-TURRAX T50, manufactured by IKA Ltd.), and then is heated at 45° C. and kept for 30 minutes in the oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (C1) having the volume average particle diameter of 7.5 μm.

Preparation of Toner Particle (C2)

Preparation of White Pigment Particle Dispersion (1)

White pigment particle (1): 60 parts

Anionic surfactant (NEOGEN RK prepared by Daiichi Kogyo Seiyaku Co., Ltd.): 5 parts Ion exchange water: 240 parts The above-described materials are mixed with each other, and the mixture is dispersed for 30 minutes by using a homogenizer (ULTRA-TURRAX T50, manufactured by IKA Ltd). The ion exchange water is added to the mixture such that the solid content in the dispersion is 50% by weight, and thereby a white pigment particle dispersion (1) in which the titanium dioxide particle is dispersed is obtained.

Preparation of Toner Particle (C2)

Resin particle dispersion (1): 350 parts

White pigment particle dispersion (1): 100 parts

Release agent particle dispersion (1): 50 parts

Anionic surfactant (prepared by TAYCA CORPORATION, TaycaPower): 2 parts

The entire above-described materials and 0.001 parts of polyacrylamide aqueous solution (1) are put into a round stainless steel flask, 0.1 N of nitric acid is added to the flask, the pH is adjusted to be 6.0, and then the mixture is stirred for 30 minutes.

After that, 30 parts by weight of nitric acid aqueous solution having 10 weight % of concentration of polyaluminum chloride (prepared by Asada Chemical INDUSTRY Co., Ltd., Paho2S) is added to the resultant. Subsequently, the resultant is dispersed at 30° C. by using a homogenizer (ULTRA-TURRAX T50, manufactured by IKA Ltd.), and then is heated at 45° C. and kept for 30 minutes in an oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (C2) having the volume average particle diameter of 7.5 μm.

Preparation of Toner Particle (C3)

Preparation of White Pigment Particle (5)

0.15 mol of glycerin is added to 100 mL of a 1 mol/L titanium tetrachloride aqueous solution, and heated at 90° C. for three hours so as to form a white particle, and then resultant is filtrated. The obtained white particle is dispersed in 100 mL of ion exchange water, 0.4 mol of hydrochloric acid is added thereto, and the resultant is heated again at 90° C. for three hours. the pH of the resultant is adjusted to be 7 with 0.1 N of sodium hydroxide, filtrated, washed by water, and then dried (105° C. for 12 hours), thereby obtaining a white pigment particle (5) which is a titanium dioxide particle. The number average of the maximum Feret diameter in the primary particle of the obtained white pigment particles is 100 nm and the average circularity is 0.90.

Preparation of White Pigment Particle Dispersion (5)

White pigment particle (5): 60 parts

Anionic surfactant (NEOGEN RK prepared by Daiichi Kogyo Seiyaku Co., Ltd.): 5 parts Ion exchange water: 240 parts The above-described materials are mixed with each other, and the mixture is dispersed for 30 minutes by using a homogenizer (ULTRA-TURRAX T50, manufactured by IKA Ltd). The ion exchange water is added to the mixture such that the solid content in the dispersion is 50% by weight, and thereby a white pigment particle dispersion (5) in which the titanium dioxide particle is dispersed is obtained.

Preparation of Toner Particle (C3)

Resin particle dispersion (1): 350 parts

White pigment particle dispersion (5): 100 parts

Release agent particle dispersion (1): 50 parts

Anionic surfactant (prepared by TAYCA CORPORATION, TaycaPower): 2 parts 30 parts by weight of nitric acid aqueous solution having 10 weight % of concentration of polyaluminum chloride (prepared by Asada Chemical INDUSTRY Co., Ltd., Paho2S) is added to the entire above-described materials. Then, the mixture is dispersed at 30° C. by using a homogenizer (ULTRA-TURRAX T50, manufactured by IKA Ltd.), and then is heated at 45° C. and kept for 30 minutes in the oil bath for heating.

After that, 100 parts of resin particle dispersion (1) is further added and kept for one hour, the pH is adjusted to be 8.5 by adding 0.1 N sodium hydroxide aqueous solution, the resultant is heated up to 85° C. while continuously stirring, kept for five hours, cooled up to 20° C. at speed of 20° C./min, filtrated, sufficiently washed with ion exchange water, and then dried so as to obtain a toner particle (C3) having the volume average particle diameter of 7.5 μm.

Preparation of Toner Particle (C4)

Polyester resin (1): 87 parts

Paraffin wax (HNP-9, manufactured by Nippon Seiro, Co., Ltd.): 5 parts

White pigment particle (1): 7 parts

Charge control agent (BONTRON P-51 prepared by ORIENT CHEMICAL INDUSTRIES CO., LTD.): 1 part The above-described components are pre-mixed by using 75 L of Henschel mixer, and then the kneading is performed under the following conditions by using a twin-continuous kneader (EXTRUDER, manufactured by Kurimoto, Ltd.) having a screw structure, thereby obtaining a kneaded material. Specifically, the kneading is performed under the conditions of a kneading temperature: 180° C., a rotation speed: 300 rpm, and a kneading speed: 100 kg/h.

The obtained kneaded material is pulverized by using 400AFG-CR pulverizer (manufactured by Hosokawa Micron Corporation), and then fine powders and coarse powders are removed by using an air elbow jet classifier (manufactured by MATSUBO Corporation), thereby obtaining a toner particle (C4).

Preparation of Toner Particle (C5)

Preparation of Oil Phase Liquid (3)

Unmodified polyester resin (2): 136 parts

White pigment particle dispersion (1): 100 parts

Ethyl acetate: 56 parts

After the above-described components are stirred and mixed, 75 parts of release agent particle dispersion (2) is added to the obtained mixture, and the mixture is stirred so as to obtain an oil phase liquid (3).

Preparation of Aqueous Phase Liquid (3)

Styrene acrylic resin particle dispersion (2): 60 parts

2% by weight of aqueous solution of CELOGEN BS-H (prepared by Daiichi Kogyo Seiyaku Co., Ltd.): 200 parts Ion exchange water: 200 parts The above-described components are stirred and mixed with each other so as to obtain an aqueous phase liquid (3).

Preparation of Toner Particle (C5)

Oil phase liquid (3): 300 parts

Isocyanate modified polyester prepolymer (2): 25 parts

Ketimine compound (2): 0.5 parts

After an oil phase liquid (3P) is obtained by putting the above-described components into a container and stirring the components for two minutes by using a homogenizer (ULTRA-TURRAX T50, manufactured by IKA Ltd.), 1,000 parts of aqueous phase liquid (3) is added to the container, and the mixture is stirred for 20 minutes by using the homogenizer. Subsequently, the mixed solution is stirred with a propeller stirrer at room temperature (25° C.) and normal pressure (1 atm) for 48 hours to react the isocyanate modified polyester prepolymer (2) with the ketimine compound (2) so as to prepare a urea modified polyester resin, and remove an organic solvent, thereby forming a particulate. Then, the particulate is washed with water, dried, and classified so as to obtain a toner particle (C5).

The volume average particle diameter of the obtained toner particle (C5) which is measured by the method described above is 6.1 μm.

Preparation of Toner (1)

100 parts of the obtained toner particle (1) and 0.7 parts of dimethyl silicone oil-treated silica particles (RY 200 prepared by Nippon Aerosil Co., Ltd.) are mixed by using a Henschel mixer so as to obtain a toner.

Preparation of Toners (2) to (12), and (C1) to (C5)

The toners (2) to (12), and (C1) to (C5) are obtained by using the same method as that used in the case of the toner (1) except that the toner particles (2) to (12), (C1) to (C5) are used instead of the toner particle (1).

The content of the white pigments ("content (% by weight)" in Tables 1 and 2) with respect to the entire toner particles in the obtained toner is indicated in Tables 1 2.

In addition, regarding the obtained toner, the particle size distribution and the circularity of the white pigment particle present in the toner particle are obtained by using the above-described method. The ratio of the white pigment particle ("ratio of small diameter (% by number)" in Tables 1 and 2) having a maximum Feret diameter of 200 nm or more and less than 400 nm, the ratio of the white pigment particle ("ratio of large diameter (% by number)" in Tables 1 and 2) having a maximum Feret diameter of 650 nm or more and less than 1,000 nm, the minimum value ("minimum value of frequency in middle diameter" in Tables 1 and 2) of a frequency with respect to particles having a maximum Feret diameter of 500 nm or more and less than 650 nm, the maximum value ("maximum value of frequency in large diameter" in Tables 1 and 2) of a frequency with respect to particles having a maximum Feret diameter of 650 nm or more and less than 1,000 nm, the large sized particle form ("large diameter form" in Tables 1 and 2, that is, a large sized particle is an aggregate ("aggregation" in Table 1) or an isolated particle ("isolation" in Tables 1 and 2)), the ratio of white pigment particle ("circularity of 0.85 (% by number)" in Tables 1 and 2) having a circularity of 0.85 or more, and the ratio of the white pigment particle ("circularity of 0.90 (% by number) or more" in Tables 1 and 2) having a circularity of 0.90 or more are illustrated in Tables 1 and 2.

Preparation of Developer (1)

Ferrite particle (number average particle diameter of 50 μm): 100 parts

Toluene: 14 parts

Copolymer of styrene and methyl methacrylate (copolymerization ratio of 15/85): 3 parts Carbon black: 0.2 parts The above-described components excluding the ferrite particle are dispersed by using a sand mill so as to prepare a dispersion, and the obtained dispersion is put into a vacuum degassing type kneader together with the ferrite particle, and then is dried under reduced pressure with stirring, thereby obtaining a carrier.

Then, 8 parts of toner (1) is mixed to 100 parts of the carrier, so as to obtain a developer (1).

Preparation of Developers (2) to (12), and (C1) to (C5)

The developers (2) to (12) and (C1) to (C5) are obtained by using the same method as that used in the case of the developer (1) except that the toners (2) to (12) and (C1) to (C5) are used instead of the toner (1).

Evaluation

Evaluation of Toner Fluidity

Images are formed under an environment of a temperature of 32° C. and a humidity of 85% with a developer containing the toner ("types" in Tables 1 and 2) indicated in Tables 1 and 2, and the poor supply of the toner is confirmed as described below so as to evaluate the toner fluidity.

Specifically, a driving unit of an image forming apparatus ApeosPort-II C7500 manufactured by Fuji Xerox Co., Ltd. is modified to manufacture an experimental machine by which 115 sheets of printed matters are printed per minute.

A test is conducted by alternately and consecutively forming 1,000 sheets of images having a low image density (image area coverage of 0.5%) and 1,000 sheets of images having a high image density (image area coverage of 30%) in a duplex output mode by using the image forming apparatus (obtained experimental machine), and continuously printing 100,000 sheets of images. The test is conducted in an environment of a room temperature of 32° C. and a humidity of 85%.

As a sheet, a printing sheet CP (a high quality printer sheet) manufactured by Fuji Xerox Co., Ltd. is used.

Abnormal noises (gear jumping sound, rubbing sound, and vibration sound) derived from the toner supply device under the test and the toner clogging in the feeding path are confirmed while continuously performing the printing.

The evaluation criteria are as follows and the results are indicated in Tables 1 and 2 ("fluidity" in Tables 1 and 2).

A: 100,000 sheets or more may be output without toner clogging

B: Toner clogging occurs in the range of equal to or more than 50,000 sheets and less than 100,000 sheets C: Toner clogging occurs in the range of equal to or more than 10,000 sheets and less than 50,000 sheets D: Toner clogging occurs in the range of equal to or more than 1 sheet and less than 10,000 sheets Evaluation of Concealing Properties of Image Images are formed under an environment of a temperature of 25° C. and a humidity of 60% with a developer containing the toner ("types" in Tables 1 and 2) indicated in Tables 1 and 2, and the whiteness of the obtained image is confirmed as described below so as to evaluate the concealing properties of the image by the white pigment.

Specifically, ApeosPortIV C4470 manufactured by Fuji Xerox Co., Ltd. is prepared, the developer is put into a developing device, and a replenishment toner (the same toner as the toner contained in the developer) is put into a toner cartridge. Continuously, a solid image of 5 cm×5 cm with 100% of white image area ratio is formed on black paper (M Kentrasher Black, manufactured by Heiwa Paper Industries Co., Ltd.) and 100 sheets are continuously printed. L* is measured with respect to the obtained 100th image (a solid image of 5 cm×5 cm with 100% of image area ratio) by using a reflection spectral densitometer (trade name: Xrite-939, manufactured by X-Rite Co., Ltd).

The larger the value of L* of the white image, the higher the whiteness of the image and the higher the concealing properties of the image due to the white pigment. A case where L* is 75 or more is set as an allowable range for practical use.

The evaluation criteria are as follows and the results are indicated in Tables 1 and 2 ("concealing properties" in Tables 1 and 2).

A: L* is 85 or more

B: L* is 80 or more and less than 85

C: L* is 75 or more and less than 80

D: L* is less than 75

TABLE 1

| | Toner | | White pigment | | | | | | | | Evaluation | |
|---|---|---|---|---|---|---|---|---|---|---|---|---|
| | Types | Method | Content (% by weight) | Ratio of small diameter (% by number) | Ratio of large diameter (% by number) | Minimum value of frequency in middle diameter | Maximum value of frequency in large diameter | Large diameter form | Circularity of 0.85 (% by number) | Circularity of 0.90 (% by number) | Toner fluidity | Concealing properties |
| Example 1 | (1) | Aggregation and coalescence method | 20 | 70 | 15 | 2 | 30 | Aggregation | 78 | 20 | A | A |
| Example 2 | (2) | Aggregation and coalescence method | 20 | 80 | 5 | 2 | 10 | Aggregation | 82 | 20 | B | A |
| Example 3 | (3) | Aggregation and coalescence method | 20 | 55 | 30 | 2 | 35 | Aggregation | 80 | 20 | A | B |
| Example 4 | (4) | Aggregation and coalescence method | 20 | 50 | 40 | 2 | 40 | Aggregation | 79 | 20 | A | C |
| Example 5 | (5) | Aggregation and coalescence method | 20 | 70 | 15 | 2 | 30 | Isolation | 75 | 20 | A | B |
| Example 6 | (6) | Aggregation and coalescence method | 50 | 70 | 15 | 2 | 30 | Aggregation | 76 | 20 | A | A |
| Example 7 | (7) | Aggregation and coalescence method | 10 | 70 | 15 | 2 | 30 | Aggregation | 81 | 20 | A | C |
| Example 8 | (8) | Aggregation and coalescence method | 20 | 70 | 15 | 2 | 30 | Aggregation | 80 | 40 | A | A |
| Example 9 | (9) | Aggregation and coalescence method | 20 | 70 | 15 | 2 | 30 | Aggregation | 30 | 5 | B | A |

TABLE 1-continued

| | Toner | | White pigment | | | | | | | | Evaluation | |
|---|---|---|---|---|---|---|---|---|---|---|---|---|
| | Types | Method | Content (% by weight) | Ratio of small diameter (% by number) | Ratio of large diameter (% by number) | Minimum value of frequency in middle diameter | Maximum value of frequency in large diameter | Large diameter form | Circularity of 0.85 (% by number) | Circularity of 0.90 (% by number) | Toner fluidity | Concealing properties |
| Example 10 | (10) | Kneading and pulvering method | 20 | 70 | 15 | 2 | 30 | Aggregation | 74 | 20 | A | A |
| Example 11 | (11) | Kneading and pulvering method | 20 | 70 | 15 | 2 | 30 | Isolation | 80 | 20 | A | B |
| Example 12 | (12) | Dissolution suspension method | 20 | 70 | 15 | 2 | 30 | Isolation | 83 | 20 | A | B |

TABLE 2

| | Toner | | White pigment | | | | | | | | Evaluation | |
|---|---|---|---|---|---|---|---|---|---|---|---|---|
| | Types | Method | Content (% by weight) | Ratio of small diameter (% by number) | Ratio of large diameter (% by number) | Minimum value of frequency in middle diameter | Maximum value of frequency in large diameter | Large diameter form | Circularity of 0.85 (% by number) | Circularity of 0.90 (% by number) | Toner fluidity | Concealing properties |
| Comparative Example 1 | (C1) | Aggregation and coalescence method | 20 | 95 | 0 | 0 | 0 | Isolation | 80 | 20 | D | A |
| Comparative Example 2 | (C2) | Aggregation and coalescence method | 20 | 60 | 15 | 30 | 15 | Isolation | 80 | 20 | D | C |
| Comparative Example 3 | (C3) | Aggregation and coalescence method | 20 | 30 | 0 | 0 | 0 | Isolation | 80 | 20 | D | D |
| Comparative Example 4 | (C4) | Kneading and pulvering method | 20 | 95 | 0 | 0 | 0 | Isolation | 80 | 20 | D | A |
| Comparative Example 5 | (C5) | Dissolution suspension method | 20 | 95 | 0 | 0 | 0 | Isolation | 80 | 20 | D | A |

From the above results, it is found that in these examples, the deterioration of the toner fluidity is prevented as compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing a binder resin and a white pigment, with a content of the white pigment being from 10% by weight to 50% by weight with respect to the entire toner particles, wherein the white pigment comprises particles having a maximum Feret diameter ranged between 500 nm and 1,000 nm, and wherein, in a particle size distribution of a maximum Feret diameter of particles of the white pigment present in the toner particle, a ratio of particles of the white pigment having a maximum Feret diameter of 200 nm or more and less than 400 nm is 50% by number or more with respect to the entire particles of the white pigment, and a maximum value of a frequency with respect to particles of the white pigment having a maximum Feret diameter of 650 nm or more and less than 1,000 nm is larger than a minimum value of a frequency with respect to particles of the white pigment having a maximum Feret diameter of 500 nm or more and less than 650 nm.

2. The electrostatic charge image developing toner according to claim 1, wherein, in the particle size distribution of a maximum Feret diameter of particles of the white pigment present in the toner particle, the ratio of particles of the white pigment having a maximum Feret diameter of 650 nm or more and less than 1,000 nm is from 5% by number to 30% by number with respect to the entire particles of the white pigment.

3. The electrostatic charge image developing toner according to claim 1, wherein, in the particle size distribution of a maximum Feret diameter of particles of the white pigment present in the toner particle, particles of the white pigment having a maximum Feret diameter of 650 nm or more and less than 1,000 nm are in the form of an aggregate.

4. The electrostatic charge image developing toner according to claim 1, wherein a ratio of particles of the white pigment having a circularity of 0.85 or more is 50% by number or more with respect to the entire particles of the white pigment present in the toner particle.

5. The electrostatic charge image developing toner according to claim 1, wherein a ratio of particles of the white pigment having a circularity of 0.90 or more is 20% by number or more with respect to the entire particles of the white pigment present in the toner particle.

6. The electrostatic charge image developing toner according to claim 1, wherein the binder resin contains a polyester resin having a glass transition temperature of 50° C. to 80° C.

7. The electrostatic charge image developing toner according to claim 1, wherein the binder resin contains a modified polyester resin.

8. The electrostatic charge image developing toner according to claim 1, wherein the binder resin contains a urea modified polyester resin.

9. The electrostatic charge image developing toner according to claim 1, wherein the white pigment contains titanium dioxide.

10. The electrostatic charge image developing toner according to claim 1, wherein an average circularity of the toner particles is from 0.94 to 1.00.

11. An electrostatic charge image developer comprising:

the electrostatic charge image developing toner according to claim 1.

12. A toner cartridge comprising:

a container that contains the electrostatic charge image developing toner according to claim 1, wherein the toner cartridge is detachable from an image forming apparatus.

* * * * *